US012151866B2

(12) United States Patent
Creager et al.

(10) Patent No.: US 12,151,866 B2
(45) **Date of Patent: *Nov. 26, 2024**

(54) PACKAGING SYSTEM FOR DISTRIBUTION, STORING AND DISPLAYING FRAGILE ITEMS

(71) Applicant: LIT BRANDS LLC, Denver, CO (US)

(72) Inventors: Andrew Creager, Denver, CO (US); William Cowan, Westminster, CO (US); Zachary Taylor, Arvada, CO (US); Donald L. Creager, III, Denver, CO (US); Max Creager, Denver, CO (US)

(73) Assignee: LIT BRANDS, LLC, Denver, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/321,525

(22) Filed: May 22, 2023

(65) Prior Publication Data

US 2023/0294897 A1 Sep. 21, 2023

Related U.S. Application Data

(63) Continuation of application No. 17/381,704, filed on Jul. 21, 2021, now Pat. No. 11,691,798.
(Continued)

(51) Int. Cl.
*B65D 77/04* (2006.01)
*B65D 5/42* (2006.01)
(Continued)

(52) U.S. Cl.
CPC ..... *B65D 77/042* (2013.01); *B65D 5/4204* (2013.01); *B65D 5/5038* (2013.01);
(Continued)

(58) Field of Classification Search
CPC .. B65D 77/042; B65D 5/4204; B65D 5/5038; B65D 5/52; B65D 5/5425; B65D 85/30; B65D 2577/043; B65D 2577/042
(Continued)

(56) References Cited

U.S. PATENT DOCUMENTS 1,818,908 A * 8/1931 Pouchain ..... B65D 77/042 229/906
1,831,920 A * 11/1931 Marsh ..... B65D 77/042 206/782

(Continued)

*Primary Examiner* — Ernesto A Grano
(74) *Attorney, Agent, or Firm* — Martensen IP; Michael C. Martensen; Chad G. Clark

(57) ABSTRACT

A packaging system for fragile items comprising an outer box, a tray insert and a plurality of inner boxes. The system protects items during distribution, and easily convert into a display system for the items at the point of retail sale. Each item is contained in its own inner box, which includes one or more viewing windows to allow a purchaser easily to view the items. The inner boxes fit removably within paired holes in the tray insert, which provides multiple points of contact to hold the boxes in place, yet allows flexibility to protect the items from impact forces and to allow easy access by a purchaser. The tray insert fits within the outer box, which provides impact and debris protection during transit, and converts to a display mode. Both the outer box and each inner box may be marked with a code to allow inventory tracking.

11 Claims, 32 Drawing Sheets

Related U.S. Application Data

(60) Provisional application No. 63/054,552, filed on Jul. 21, 2020.

(51) Int. Cl.
*B65D 5/50* (2006.01)
*B65D 5/52* (2006.01)
*B65D 5/54* (2006.01)
*B65D 85/30* (2006.01)

(52) U.S. Cl.
CPC ..... *B65D 5/52* (2013.01); *B65D 5/5425* (2013.01); *B65D 85/30* (2013.01); *B65D 2577/043* (2013.01)

(58) Field of Classification Search
USPC ..... 206/763
See application file for complete search history.

(56) References Cited

U.S. PATENT DOCUMENTS 1,982,390 A * 11/1934 Lewis ..... B65D 77/042 206/229
2,522,049 A * 9/1950 Lang ..... B65D 5/46008 229/149
2,761,785 A * 9/1956 Steger ..... B65D 71/16 229/905
3,692,228 A * 9/1972 Spiegel ..... B65D 71/16 206/427
4,113,100 A * 9/1978 Soja ..... B65D 5/5445 229/164
4,448,303 A * 5/1984 Beckenfeld ..... B65D 5/524 206/45.3
4,530,459 A * 7/1985 Maroszek ..... B65D 77/042 229/120.32
5,402,889 A * 4/1995 Hermann ..... B65D 5/4233 206/443
6,135,289 A * 10/2000 Miller ..... B65D 5/5088 206/774
6,296,120 B1 * 10/2001 Danko ..... B65D 5/503 229/906
8,272,509 B1 * 9/2012 McCutchen ..... B25H 3/021 206/763
D687,321 S * 8/2013 Pralus ..... D9/414
9,061,790 B2 * 6/2015 Yagishita ..... B65D 5/4229
D734,075 S * 7/2015 Tapper ..... D6/672
D755,641 S * 5/2016 O'Neill ..... B65D 5/5088 D9/721
9,617,032 B2 * 4/2017 Gamble ..... B65D 5/5038
D844,456 S * 4/2019 O'Neill ..... D9/737
D848,862 S * 5/2019 O'Neill ..... D9/737
D871,924 S * 1/2020 Vanderwell ..... D9/755
D881,021 S * 4/2020 Bandinu ..... D9/755
D906,840 S * 1/2021 O'Neill ..... D9/737
D927,988 S * 8/2021 O'Neill ..... D9/759
D928,631 S * 8/2021 O'Neill ..... D9/759
11,420,786 B1 * 8/2022 Ansola, III ..... B65D 71/72
11,427,376 B2 * 8/2022 Vanderwell ..... B65D 5/5061
2003/0209454 A1 * 11/2003 Hunter ..... B65D 21/0238 206/217
2006/0278559 A1 * 12/2006 Hamblin ..... B65D 71/72 206/562
2013/0255195 A1 * 10/2013 Gasber ..... B65B 59/001 53/147
2014/0008250 A1 * 1/2014 Picciolo ..... B65D 71/72 206/141
2017/0076343 A1 * 3/2017 Bernstein ..... A47F 5/0025
2019/0344924 A1 * 11/2019 Gessler, Jr. ..... B65D 77/0413
2020/0375337 A1 * 12/2020 Tan ..... B65D 25/108

* cited by examiner

PACKAGING SYSTEM FOR DISTRIBUTION, STORING AND DISPLAYING FRAGILE ITEMS

CROSS-REFERENCE TO RELATED APPLICATIONS

The present application is a continuation of U.S. patent application Ser. No. 17/381,704 filed 21 Jul. 2021, which relates to and claims benefit of priority from U.S. Provisional Application No. 63/054,552 filed 21 Jul. 2020, both of which are hereby incorporated by reference in their entirety for all purposes as if fully set forth herein.

BACKGROUND OF THE INVENTION

Field of the Invention

Embodiments of the present invention relate, in general, to a system to protect fragile items from breakage and more particularly to a singular system that protects fragile items from breakage during distribution and storing and can display the items for sale without removing or altering the individual item packaging.

Relevant Background

Storing, distributing, and selling fragile articles such as pipes has long been a challenge. Typically, such items are housed in tubs, protected with bubble wrap or packing foam, or shipped in acrylic displays. Usually pipes and similar items are required to be unwrapped at the distribution level, then re-wrapped to transport to the retailer, and then unwrapped to display at the retail location. Most pipes arrive in bundles of 2-5 pipes with a rubber band wrapped around the bundle, and then these are put in larger cases and shipped from manufacturing to distribution. It is estimated that 5-10% of pipes are cracked or broken using this method. Further this method drastically increases the amount of labor involved in the supply chain involved in wrapping, unwrapping, counting, displaying, and rewrapping the pipes.

At the distribution level, pipes are stored in large bins which, in turn, are often stored one on top the other. Such arrangements create breakage, expose pipes to contamination from dirt or dust, and make pipes vulnerable to theft. If a pipe in a bin breaks, the glass debris usually falls onto or into the other pipes in the bin, creating a possible safety hazard for employees and users. Current methods of display do not include UPC codes, making inventory tracking and loss prevention more difficult at both distribution and retail levels. When retailers receive pipes, they have to unwrap them at their location and then place them in countertop display cases (usually acrylic or plastic), or in large floor display cases for presentation to customers. These displays suffer from a lack of marketability and take up valuable retail space.

Consider the design of a typical pipe retail dispenser. The retail dispenser allows for easy viewing of the pipes, but it does not protect the pipes individually, or allow for inventory tracking on individual unit sales. A primary cause of breakage in the sale and distribution of glass pipes comes from glass-on-glass contact within a confined space. The design shown above neither shields pipes from glass-on-glass contact, nor allows a convenient way to determine if a pipe has been stolen or damaged, because of the lack of means to individually track each item. In summary, current distribution and storage means result in a substantial inventory loss rate, do not protect the cleanliness and/or safety of the pipes, are very labor intensive for unpackaging and display, do not integrate well into existing supply chains, and lack marketability and standardization.

What is needed is a system by which pipes are easily integrated into distribution and retail stores while providing inventory tracking. Further, adequate pipe protection and a compact, standardized display box is needed that provides a reduction in labor and maintenance without hindering display of the articles. The system should protect the pipes from damage and contamination, offering both inventory loss prevention and reducing liability, while also saving horizontal space in the distribution process and at retail locations. A container is needed that provides an easy and marketable means by which display products (pipes) for sale while protecting them during transit. These and other deficiencies of the prior art are addressed by one or more embodiments of the disclosed invention.

Additional advantages and novel features of this invention shall be set forth in part in the description that follows, and in part will become apparent to those skilled in the art upon examination of the following specification or may be learned by the practice of the invention. The advantages of the invention may be realized and attained by means of the instrumentalities, combinations, compositions, and methods particularly pointed out in the appended claims.

BRIEF DESCRIPTION OF THE DRAWINGS

Features and objects of the present invention and the manner of attaining them will become more apparent, and the invention itself will be best understood, by reference to the following description of one or more embodiments taken in conjunction with the accompanying drawings and figures imbedded in the text below and attached following this description.

Figure 1:
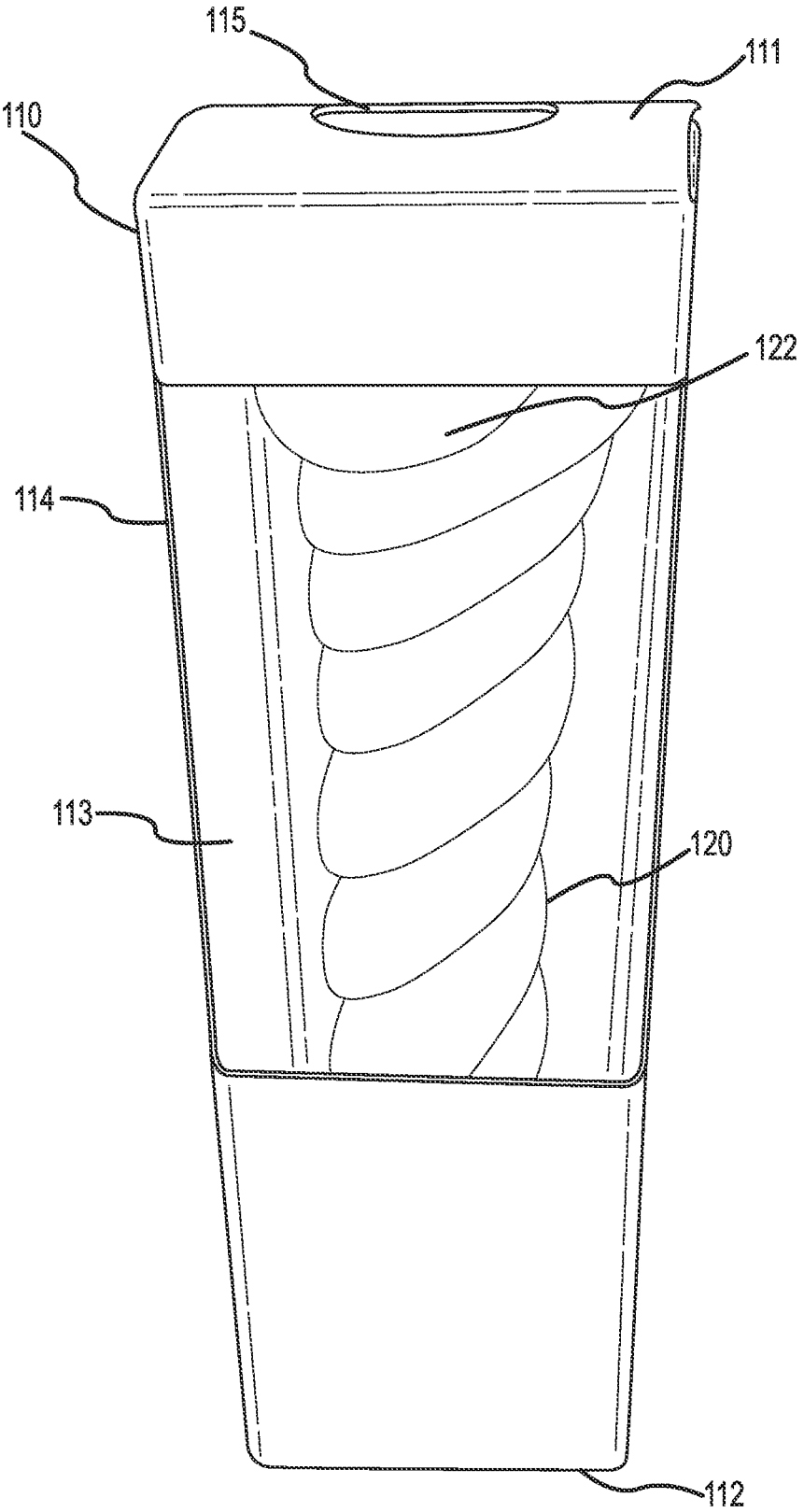
FIG. 1 depicts a trapezoidal inner box comprising at least a portion of the disclosed packaging system.

The Figures incorporated and attached depict embodiments of the present invention for purposes of illustration only. One skilled in the art will readily recognize from the following discussion that alternative embodiments of the structures and methods illustrated herein may be employed without departing from the principles of the invention described herein.

DESCRIPTION OF THE INVENTION

The present invention comprises a three-piece system containing an outer box, a tray insert, and an inner box that protect fragile items during distribution and storage, and that also can be easily converted to a display system without requiring any removal or modification to the items contained therein. The complete system operates to protect and display products with a plurality of inner boxes, each containing a fragile article such as a glass pipe. The inner boxes containing the items are placed into holes in the tray insert, which is in turn placed inside the outer box for shipping and display. In a preferred embodiment, the three elements are constructed using SBS (Solid Bleached Sulfate) material whose shapes are cut using a dye line or similar process. Other embodiments may use other suitable materials that provide similar levels of item protection, ease of manufacture, printability, and low cost. Preferred embodiments of the disclosed invention comprise a system for distribution, protection, and display of glass pipes. One of reasonable skill in the relevant art will appreciate that the scope of the invention, as defined by the claims, can also apply to other fragile, breakable items.

Embodiments of the present invention are hereafter described in detail with reference to the accompanying Figures. Although the invention has been described and illustrated with a certain degree of particularity, it is understood that the present disclosure has been made only by way of example and that numerous changes in the combination and arrangement of parts can be resorted to by those skilled in the art without departing from the spirit and scope of the invention.

The following description with reference to the accompanying drawings is provided to assist in a comprehensive understanding of exemplary embodiments of the disclosed invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Like numbers refer to like elements throughout. In the figures, the sizes of certain lines, layers, components, elements or features may be exaggerated for clarity.

The terminology used herein is for the purpose of describing particular embodiments only and is not intended to be limiting of the invention. As used herein, the singular forms "a," "an" and "the" are intended to include the plural forms as well, unless the context clearly indicates otherwise. Thus, for example, reference to "a component surface" includes reference to one or more of such surfaces.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be also understood that when an element is referred to as being "on," "attached" to, "connected" to, "coupled" with, "contacting", "mounted" etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under," "below," "lower," "over," "upper" and the like, may be used herein for ease of description to describe one element or feature's relationship to another element(s) or feature(s) as illustrated in the figures. It will be understood that the spatially relative terms are intended to encompass different orientations of a device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of "over" and "under". The device may be otherwise oriented (rotated 90 degrees or at other orientations) and the spatially relative descriptors used herein interpreted accordingly. Similarly, the terms "upwardly," "downwardly," "vertical," "horizontal," and the like are used herein for the purpose of explanation only unless specifically indicated otherwise.

Each element of the system of the present invention set is designed for the protection of a fragile item, e.g., a glass pipe, prior to, during, and after transportation, as well as providing a means for retail display. The disclosed invention has been validated for suitable protective properties using bowl and in-line glass pipes. The specifics of the four inner box designs as they are made to fit four exemplary glass pipe designs should not be considered to capture all or even most variants of the disclosed system. Indeed, given tiny modifications in the size of the box elements, the system can be extrapolated to a large variety of glass pipe styles, shapes, dimensions, and densities. The disclosed invention has been validated for use with pipes made from 'soft glass,' an extremely fragile type of glass for such uses.

With reference to FIG. 1, according to one embodiment of the disclosed invention, an inner box 110 is configured to fit a pipe 120 having a bowl 122, i.e., an area having a larger circumference, at one end. Such inner boxes are wider toward the top panel 111 and narrower toward the bottom panel 112 in order to accommodate the wider portion of the pipe at the top while restricting movement of the pipe at the bottom.

Figure 2:
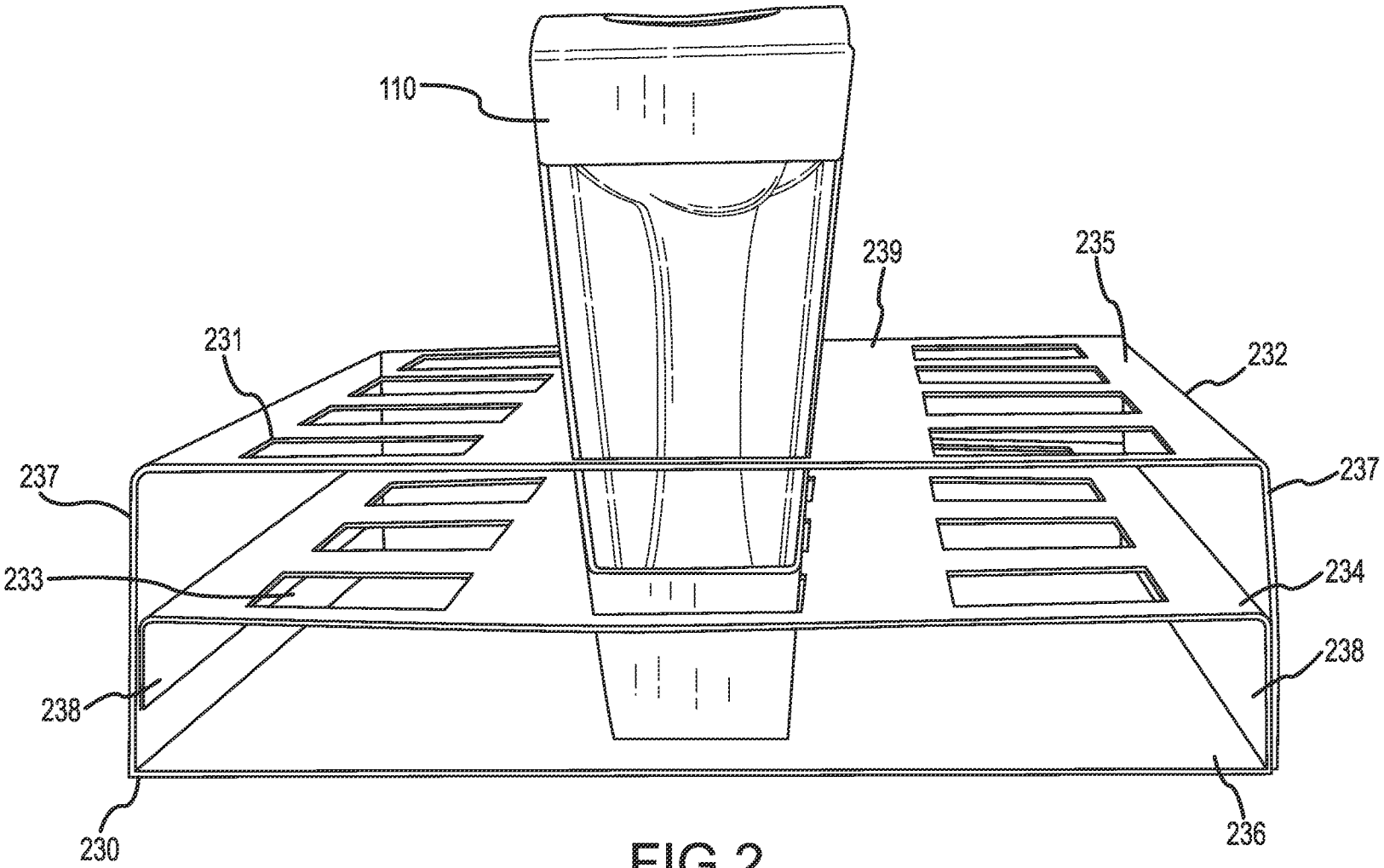
FIG. 2 depicts a trapezoidal inner box seated in a tray insert, comprising at least a portion of the disclosed packaging system.
Figure 3:
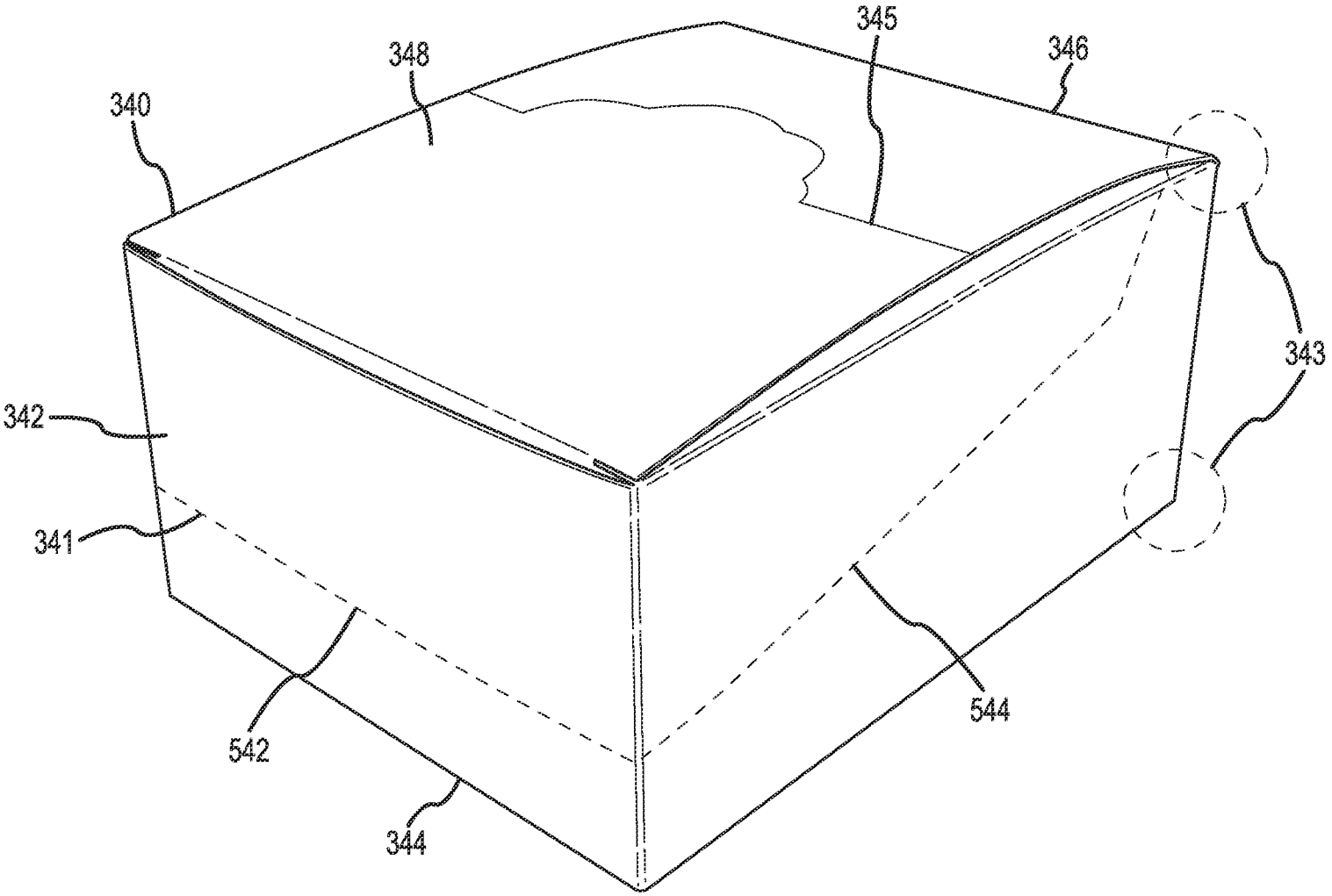
FIG. 3 depicts a closed outer box comprising at least a portion of the disclosed packaging system.

With reference to FIG. 2, a tray insert 230 configured to hold a plurality of inner boxes 110 (one is shown), is placed inside a protective outer box, see FIG. 3, item 340. The tray insert 230 is folded to include three layers or tiers of material, the top layer 232 and middle layer 234 including a plurality of aligned rectangular holes 231, 233 spaced away from the outer perimeter 235 of the tray insert, and spaced away from each of the other sets of holes 239. The spacing prevents the inner boxes 110, when secured in the tray insert holes 231, 233, from contacting the outer box walls 342 or other inner boxes secured in their individual tray insert holes. When the outer box 340 is shifted laterally or subject to impact, the lateral movement of the articles is restricted to prevent damage from item-on-item contact (next to, in front of, or behind any given article). The tray insert's top layer 232 may be spaced up from the tray's bottom layer 236 so that it contacts the inner box 110 at one third (⅓) of its length to hold the inner box securely in an upright position. The tray's middle layer 234 is spaced up from the tray's bottom layer 236 so that a portion of the inner box passes through the middle layer and rests on the bottom layer. Holes 233 in the middle layer may be smaller than the holes 231 in the top layer in the case of trapezoidal inner boxes in order to snugly fit the smaller end of the trapezoidal inner box. The tray insert's bottom layer rests 236 on the bottom of the outer box 344.

Such inner box orientation facilitates the display the pipes for retail sale and prevents excessive lateral (horizontal) movement of the pipe while allowing for easy removal of the inner box from the tray during a transaction. Removal of an individual inner box and the item therein does not alter the protective system from the remaining sleeves and items. With reference to FIG. 3, the outer box 340 provides a protective structure for the tray insert and the inner boxes, and also includes perforations or serrations 341 to allow a portion of the outer box to be removed to facilitate a retail display of the items. The disclosed packaging system provides a container for fragile glass items, e.g., glass pipes, so that they are protected during transport, both by crushable zones 343 incorporated in the outer box, and by individual item spacing from the outer box and the other items.

Figure 4:
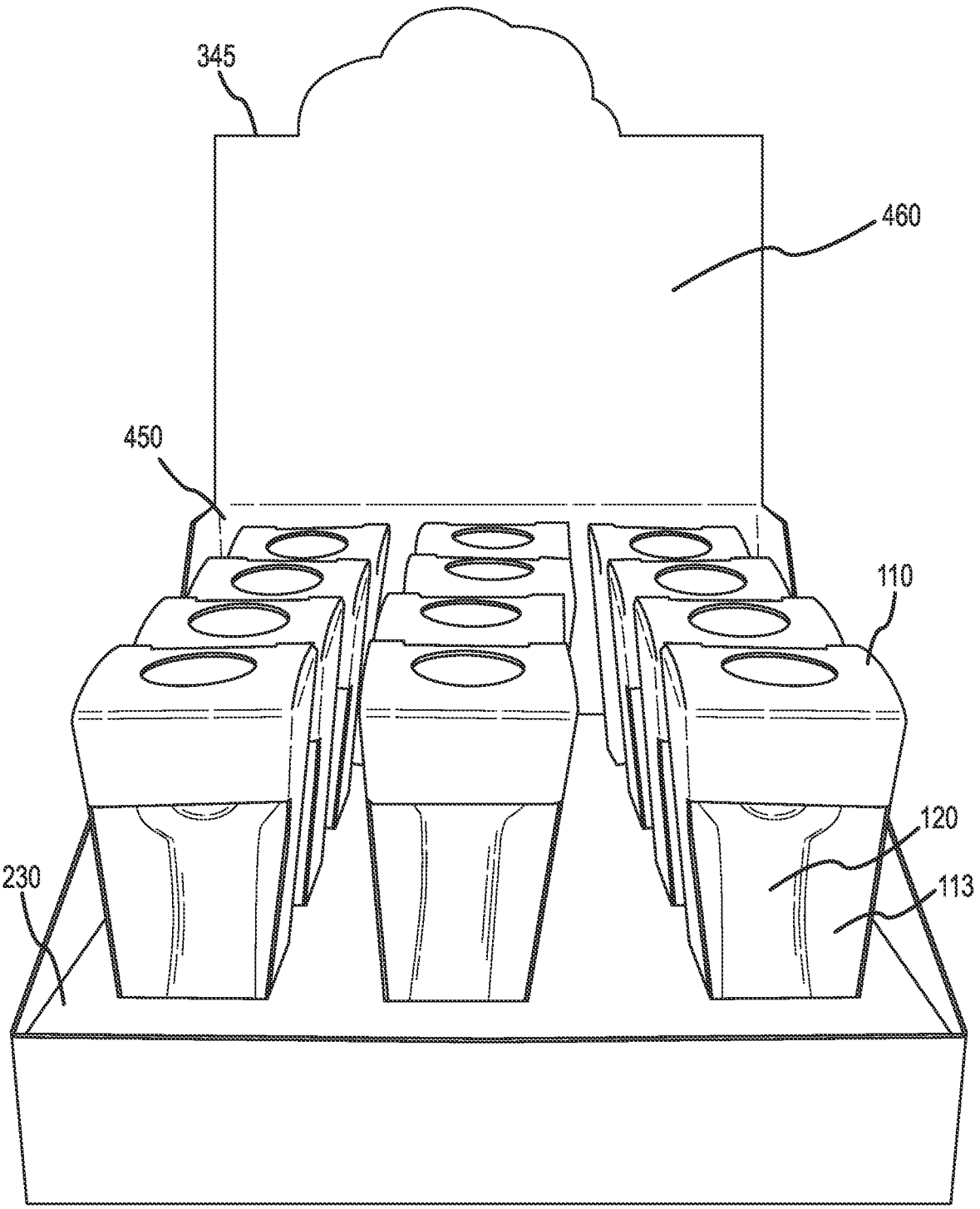
FIG. 4 depicts the system in display mode, comprising at least a portion of the disclosed packaging system.

With reference to FIG. 4, the system is also convertible into a retail display 450 of the same items 120, that are housed in inner boxes 110 and removably secured in a tray insert 230. In embodiments of the disclosed invention, pipes are vertically oriented within inner boxes, which can be seen through a front display window. Until now, articles of this type are almost always displayed for sale laying horizontally, often in an acrylic or glass case. The vertical orientation offered by the disclosed system provides a fundamentally different presentation of the items in a retail setting. The disclosed system therefore reduces the horizontal space required to store individual items in the distribution chain and on display at retail locations, since items are displayed vertically, rather than being laid out on a shelf in a horizontal orientation.

One of the primary uses of the invention is to enhance efficiency and reduce costs involved with the transportation, distribution, display, and sale of fragile items. The invention is constructed to prevent breakage in transportation and to facilitate the display of such items without the need to modify the inner packaging for retail display and sale. Further, it integrates the articles into digital supply chains by providing scalable codes both on the outer box and on each inner box. Such labeling allows for precise inventory tracking in distribution and retail environments down to the individual article.

The disclosed system also reduces labor hours spent, for example, wrapping items in bubble wrap at the manufacturer, unwrapping the items for sale in distribution, rewrapping the items for transportation to retailers, and then again unwrapping and displaying the items at the retail location. Currently an employee at the retail location places pipes for display by hand, typically the spacing is unstandardized, often resulting in wasted space if pipes are spaced too widely, or breakage if pipes are spaced too closely. The disclosed system allows more inventory safely to be stored in distribution locations and displayed in retail locations per available horizontal square foot. Finally, the system keeps dust, broken glass, and other particulate material from contaminating the items during distribution, transportation, and display.

Components of the disclosed invention include, in some embodiments:

- Outer box: houses the tray insert and the inner boxes; provides crushable zones to absorb impacts from drops; keeps the tray insert and the inner boxes clean from dust and dirt; provides structural support for the tray insert and inner boxes; can be torn open to form the retail display.
- Tray insert: holds the individual inner boxes in place; provides spacing between each inner box that keeps the items from contacting and/or damaging other items; provides spacing between the individual inner boxes and the sides of the outer box that keep the pipes from contacting the sides of the outer box.
- Inner boxes: provide individual items a window for display; reside securely but removably within spaced holes in the tray insert; protect the individual items from contact with other items, the side of the outer box, or excessive lateral or vertical movement.

Figure 5:
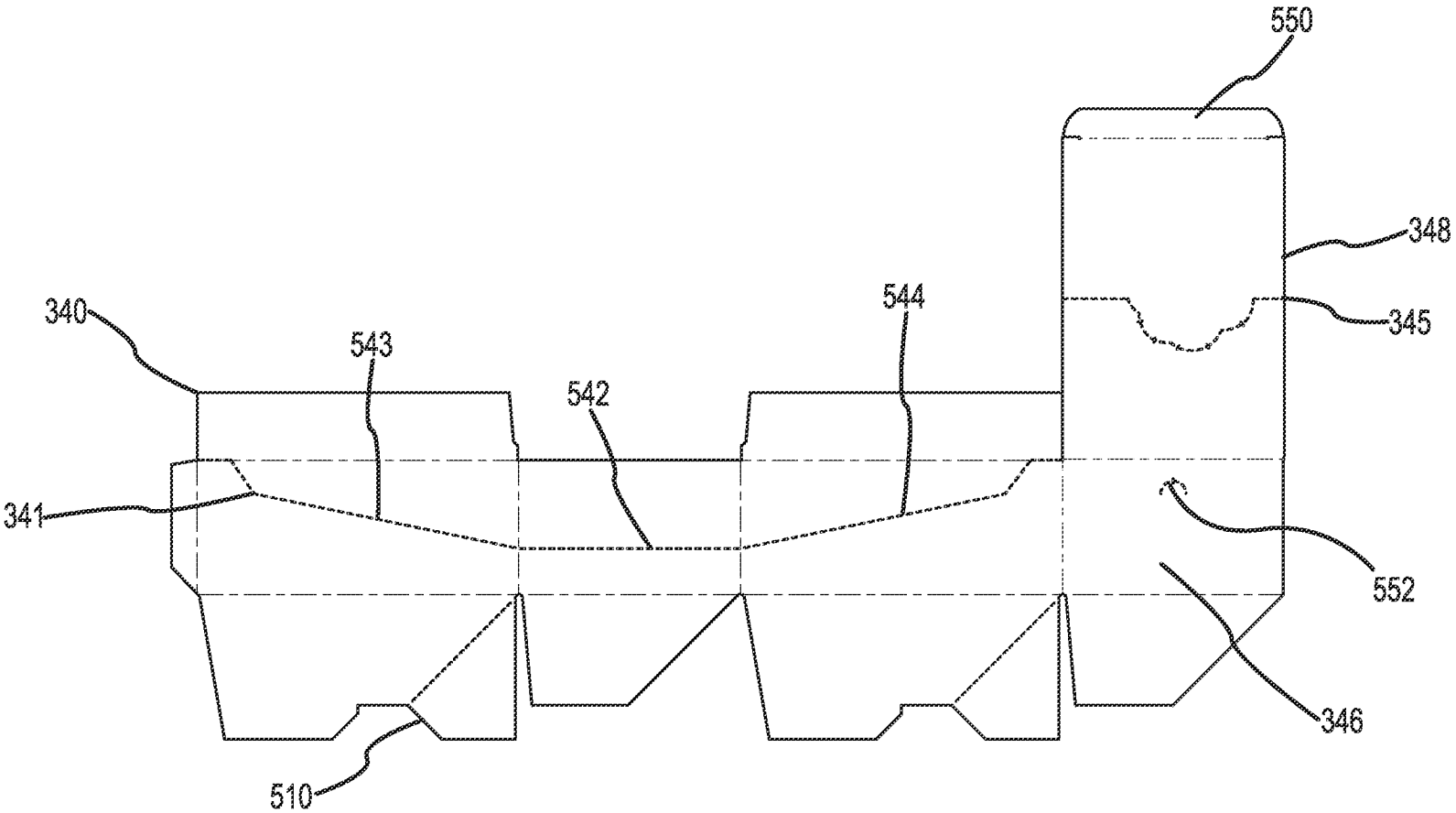
FIG. 5 depicts a pattern for an outer box prior to folding comprising at least a portion of the disclosed packaging system.
Figure 6:
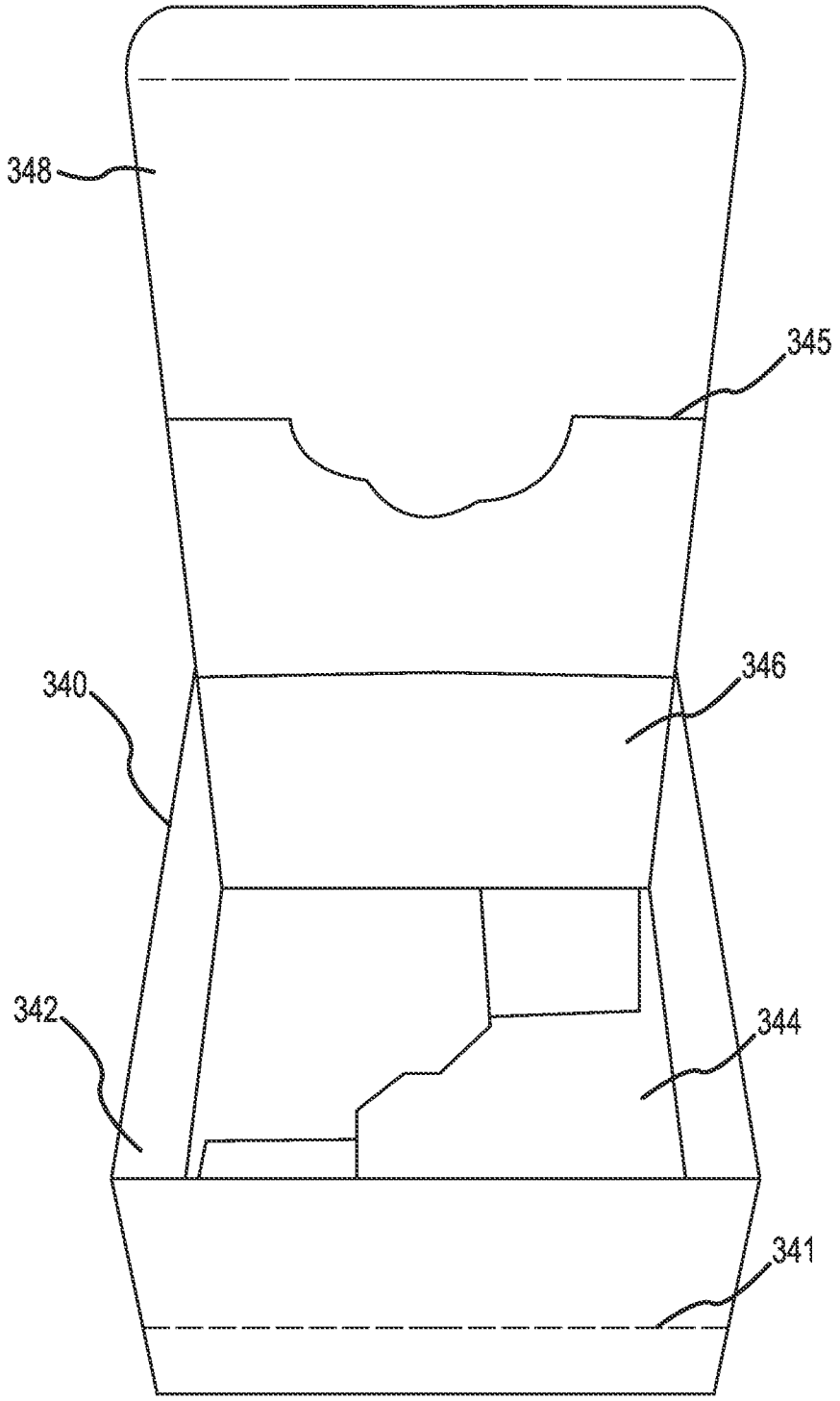
FIG. 6 depicts a front view of an open outer box comprising at least a portion of the disclosed packaging system.

The outer box is the primary structure that holds the other system components in place and provides easily can be manipulated into a display mode. The tray insert and individual inner boxes allow for compressions and movements that displace and distribute forces on the glass pipes, and the outer box sets the limits of these possible movements to maintain the integrity of the system and display. With reference to FIG. 5, which shows an outer box pattern prior to being folded into position, the outer box 340 uses a four-shaped interlocking tab configuration 510 at its bottom, and can be easily clicked into place from a flat state to form a three-dimensional (3D) state, see FIG. 6. Said interlocking tab configuration creates several locked points at the bottom of the box 344, providing stability and durability for the tray insert and a plurality of inner boxes to be carried inside, and further prevents easy disassembly after the interlocking tabs are clicked in place.

Such a robust bottom panel 344 of the outer box compliments the structure provided by the tray insert and the inner boxes to create a rigid, yet protectively malleable distribution and display system. Further, the outer box 340 includes perforated or serrated lines 341 that can be torn to create the display configuration of the system. With further reference to FIG. 5, one perforation extends across the front of the outer box, the front perforation line 542 being spaced up from the bottom of the outer box ⅓ of the height of the outer box. Another pair of side perforation lines 543, 544 extend diagonally up from each end of the front perforation line along the sides of the outer box, terminating at the back 346 and top 348 of the outer box. These perforation lines 341 allow retailers to easily tear along the perforation lines to partially remove the top and sides of the box, thereby transforming it into retail display mode.

In some embodiments, the top of the outer box includes a seam or crease 345 extending across the top from equidistant points on the sides of the outer box, e.g., ½, ⅔, ¾, etc., between the front and back of the outer box. The top 348 of the outer box may be folded along the crease 345, and secured in a vertical position via tab(s) 550 and corresponding u-shaped slot(s) 552 at the back of the box, creating a vertical display panel 460 for product and brand information, while leaving the items in their individual boxes visible from the front of the system.

With further reference to FIG. 3, the outer box 340 sides 342, 346, bottom 344 and top 348 inhibit movement of the tray insert and inner boxes, so that individual system components can compress, flex, move, crush, and deform while keeping the pipes inside from contacting other pipes or moving excessively enough to cause breakage. The outer box also provides corners and edges 343 which can compress inward to a small degree, to absorb much, if not most, of the force from an impact. Finally, the outer box is sized so that when the top panel 348 is closed, it sits just a few millimeters above the tops of the inner boxes, which prevents the inner boxes from dislodging from the insert tray when the box is inverted. Some embodiments may include an additional layer of material, e.g., paper, cardboard, bubble wrap, etc., to reduce any space between the top of the outer box and the tops of the inner boxes. The inner boxes are thus wedged in place between the top 348 and bottom 344 of the outer box, and prevented from excessive lateral movement by outer box sides 342, 346. The outer box therefore creates a protective exoskeleton which preserves the pipes in the display even if the outer box is dropped or mishandled. The outer box, tray insert, and inner boxes function together as a system to protect the pipes and maintain the display by achieving a balance between rigidity and flexibility necessary to shield the pipes and disperse impact forces away from any one focal point.

Figure 7:
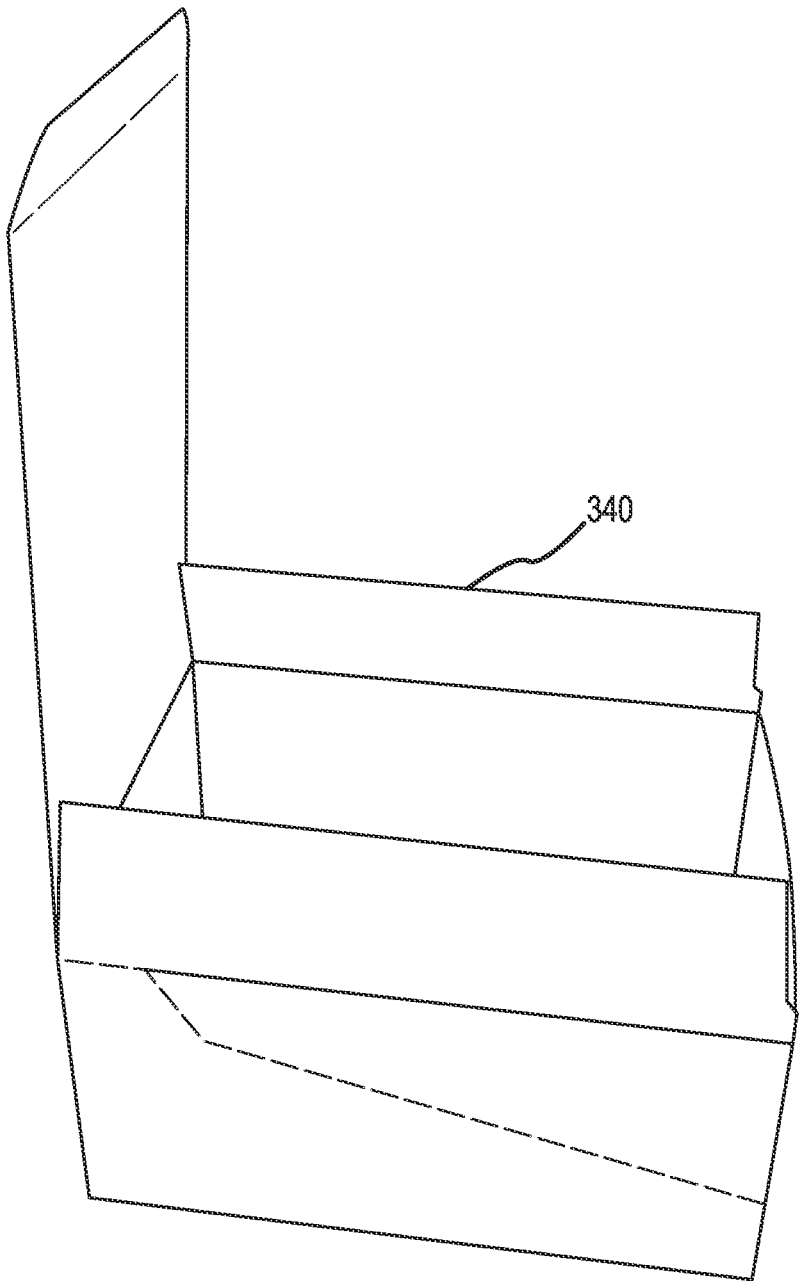
FIG. 7 depicts a left-side view of an open outer box comprising at least a portion of the FIG. 8 depicts a right-side view of an open outer box comprising at least a portion of the disclosed packaging system.
Figure 8:
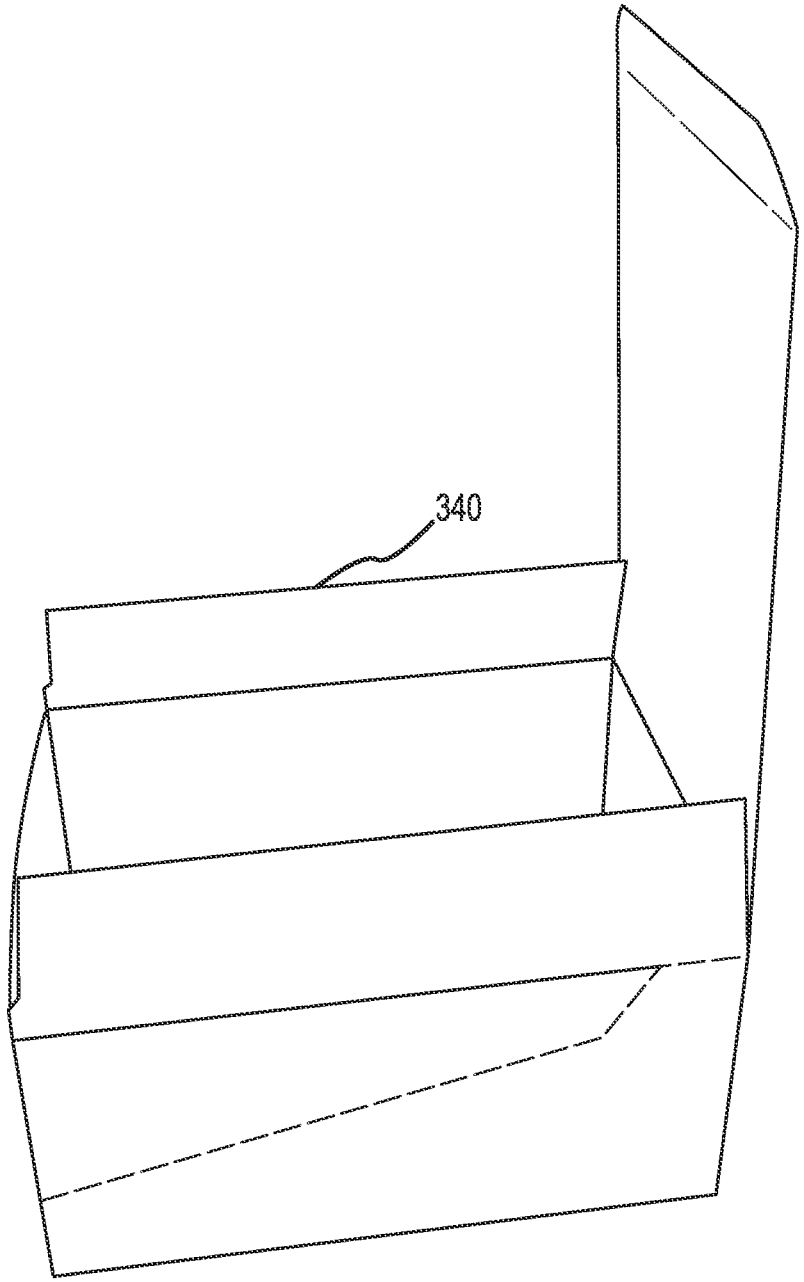
Figure 9:
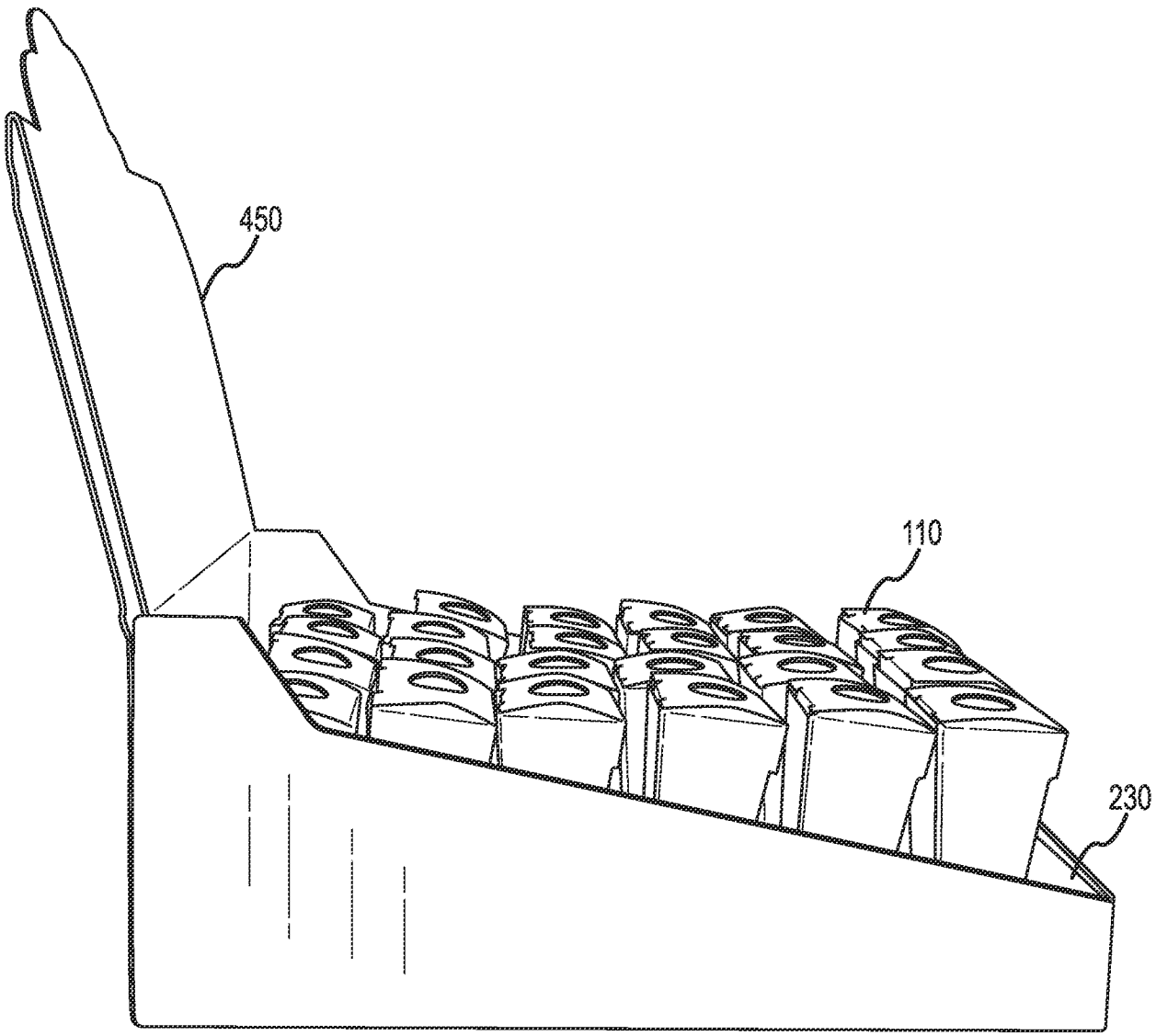
FIG. 9 depicts a left side view of the system in display mode comprising at least a portion of the disclosed packaging system.
Figure 10:
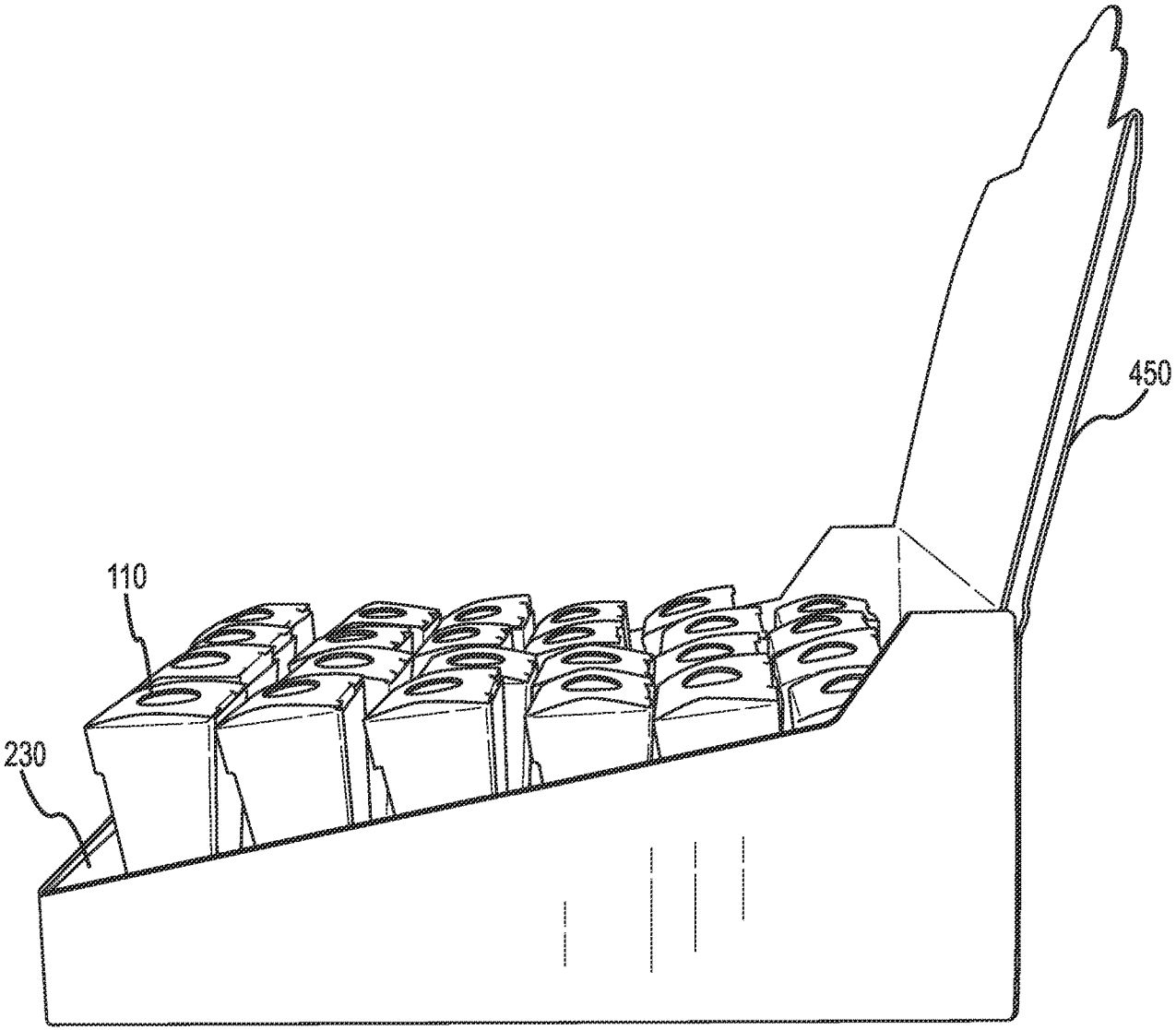
FIG. 10 depicts a right side view of the system in display mode comprising at least a portion of the disclosed packaging system.
Figure 11:
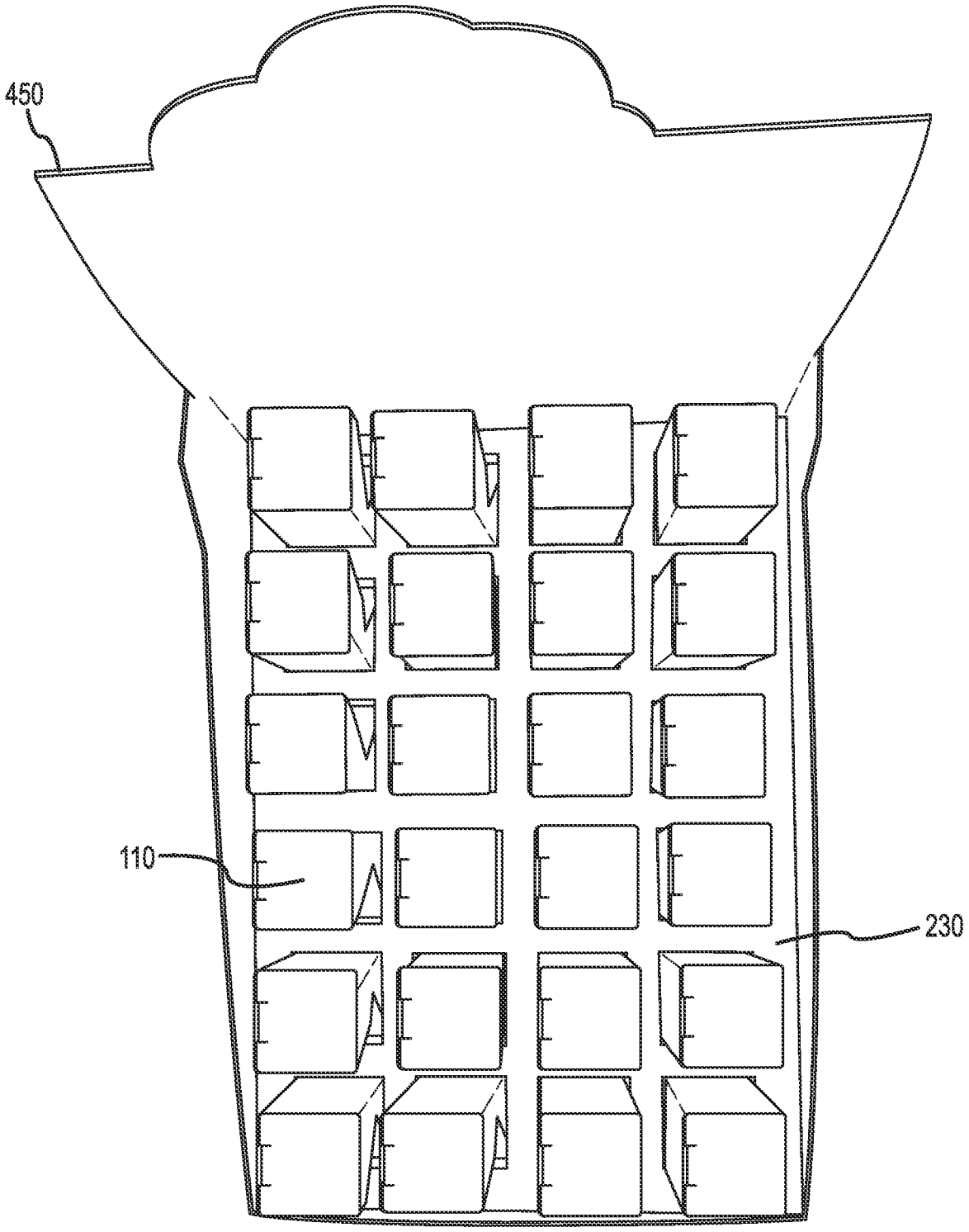
FIG. 11 depicts an overhead view of the system in display mode comprising at least a portion of the disclosed packaging system.

FIGS. 7 and 8 show additional views of the outer box 340, and FIGS. 9, 10, and 11 show additional views of the outer box in its display configuration 450, along with the inner boxes 110 and tray insert 230.

With further reference to FIG. 2, the tray insert 230 sits within the outer box, creating three horizontal tiers 232, 234, 236 that rest on the bottom of the outer box and that are spaced vertically to create contact points with the inner boxes 110 that keep the inner boxes in place. The tray insert is customized (configurable) to fit the shape of a specific length and type of item, e.g., pipes with bowls require a trapezoidal inner box that is wider at the top and narrower towards the bottom. The tray insert includes a top layer 232 that is suspended up from the bottom layer 236 by two sections 237 that support the left and right sides of the top layer. The sections 237 may be continuous with the bottom layer or adhered to another tray insert component. Some embodiments may include additional sections to support the top layer on the front and back sides so that all four sides of the top layer are supported. The tray insert also includes a middle layer 234 suspended up from the bottom layer and below the top layer by two sections 238 that support the left and right sides of the middle layer 234, and are either continuous with the bottom layer, or adhered to another tray insert component. The middle layer flaps are also adhered inside a portion of the top layer flaps 237.

Figure 12:
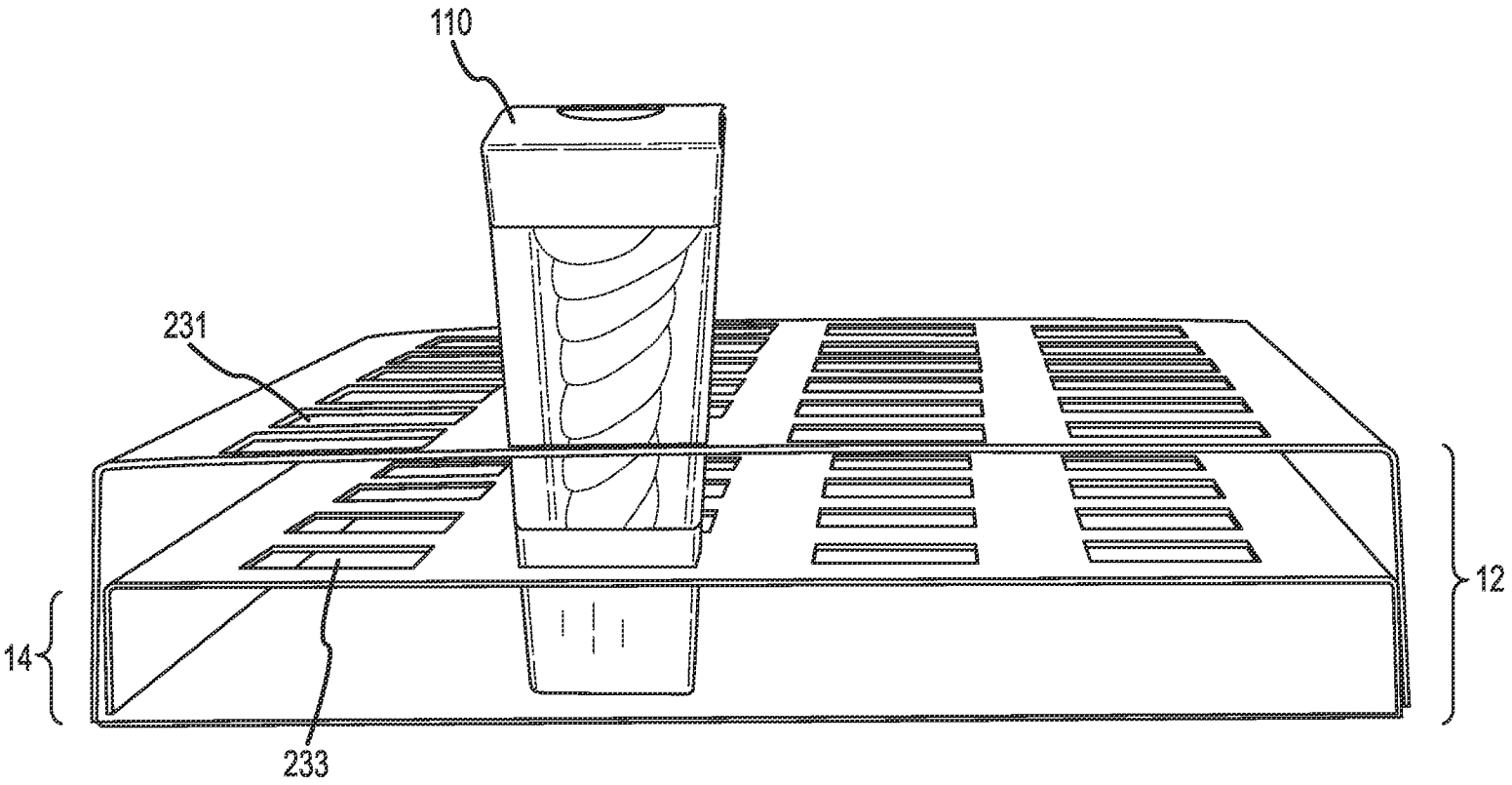
FIG. 12 depicts a trapezoidal inner box seated in a tray insert comprising at least a portion of the disclosed packaging system.
Figure 13:
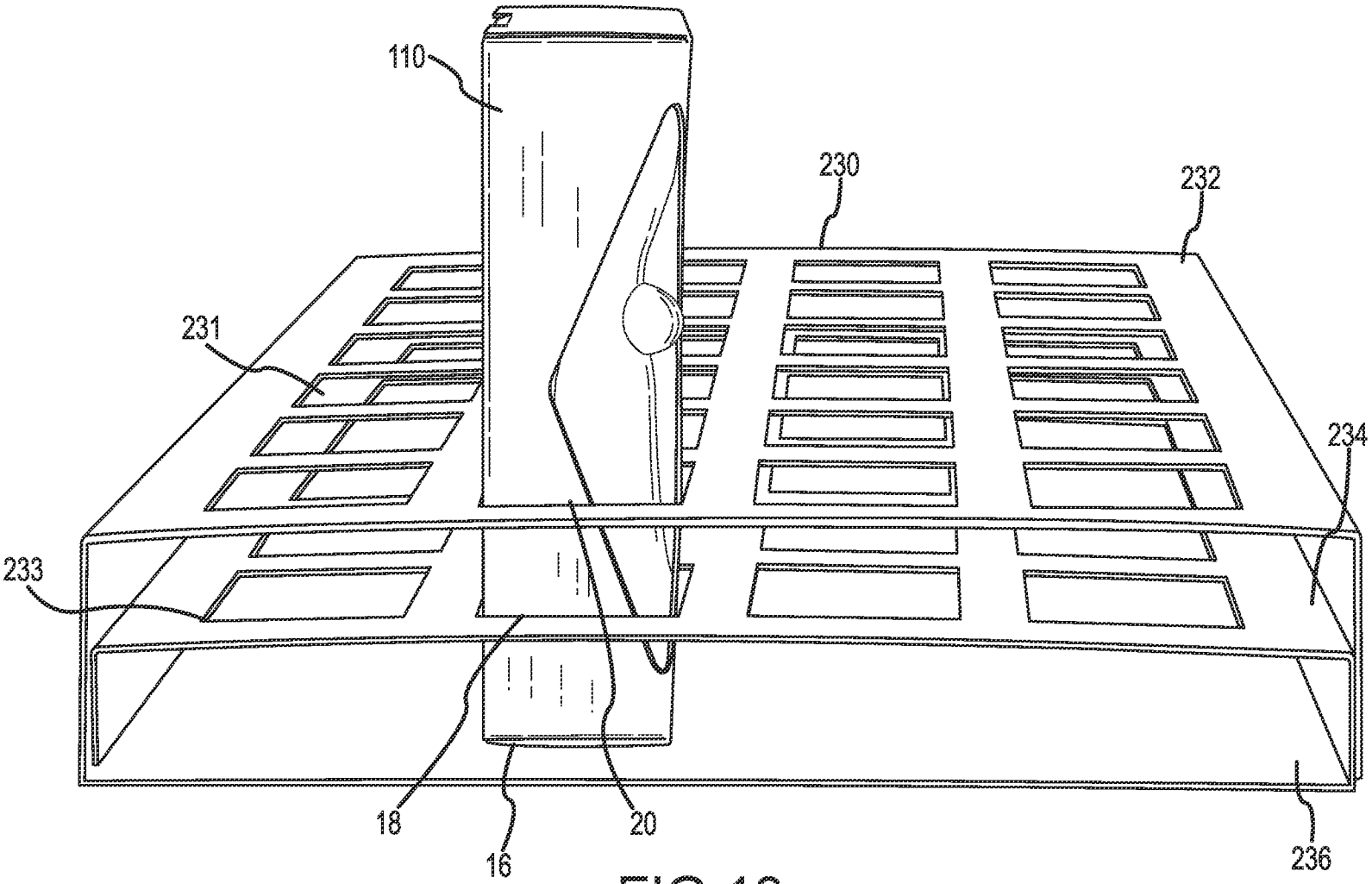
FIG. 13 depicts a rectangular inner box seated in a tray insert comprising at least a portion of the disclosed packaging system.
Figure 14:
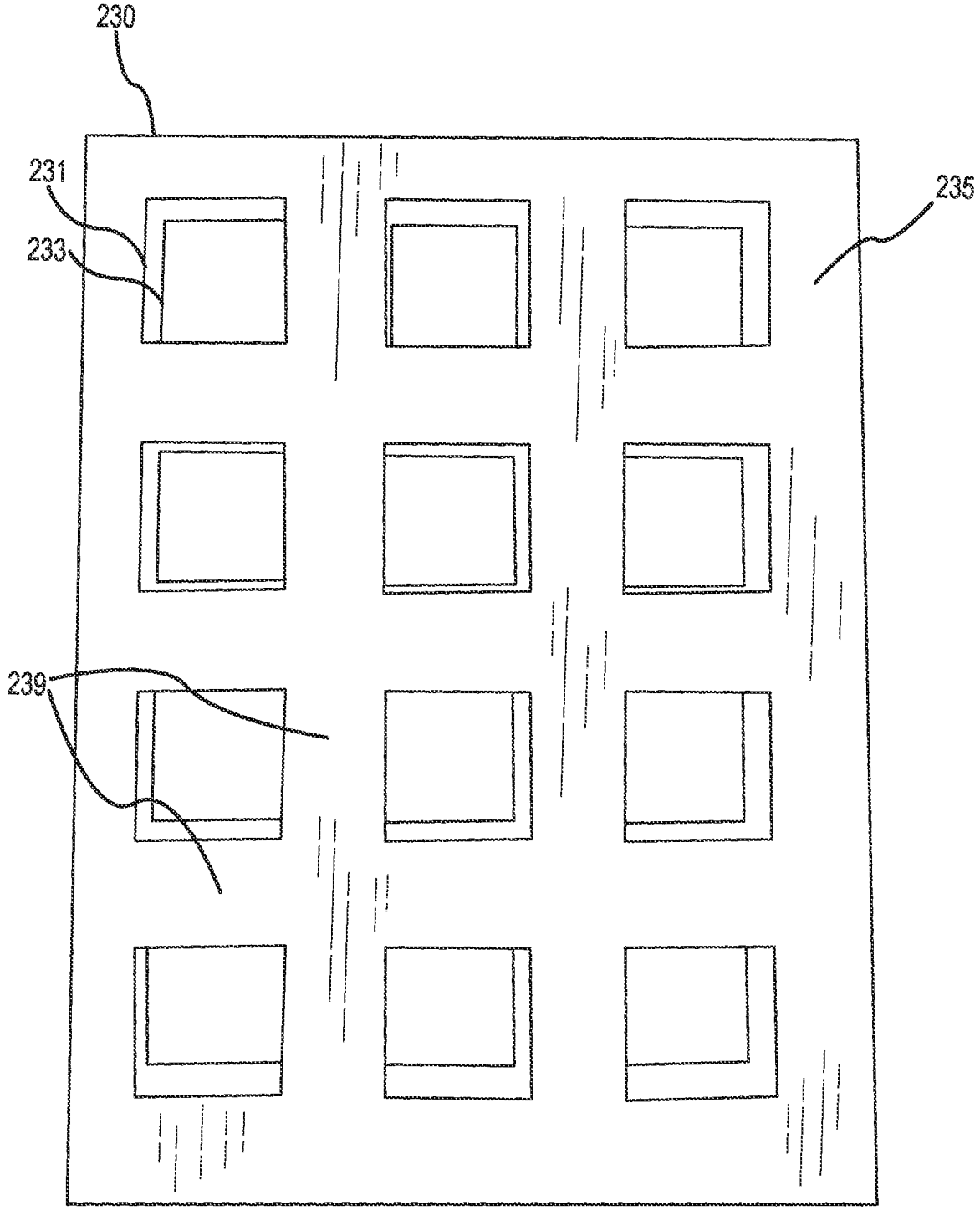
FIG. 14 depicts an overhead view of a tray insert comprising at least a portion of the disclosed packaging system.

The top 232 and middle layers 234 include paired arrays of rectangular holes 231, 233 sized and shaped to allow the inner boxes 110 to fit snugly through. Each hole 233 in the middle layer is located directly beneath a corresponding hole 231 in the top layer. With reference to FIG. 12, in embodiments configured to store trapezoidal inner boxes 110, the holes in the middle layer 233 are smaller than the holes in the top layer 231. However, with reference to FIG. 13, in embodiments configured to hold rectangular inner boxes 110, e.g., the chillum box, the middle layer 233 and top layer holes 231 are the same size. With reference to FIG. 14, The paired holes are laterally distributed in the tray insert 230 to provide space 235 between the inner boxes and the sides of the outer box, to provide space 239 and minimize contact between inner boxes, and to maximize the number of items that can be safely stored in each outer box.

The vertical spacing of the two upper tiers from the bottom layer is set to optimally secure the inner boxes in place, i.e., minimizing side-to-side movement and preventing front-to-back movement. For example, with further reference to FIG. 12, the top layer may be spaced up from the bottom layer a given distance 12 so that the inner boxes contact the top layer at ¼, ⅓, ½, ⅔, or other suitable proportion of their length (⅓ is shown). The middle layer, for example, may be spaced 14 only a few millimeters up from the bottom layer to hold the end of the inner boxes in place, could be located equidistant between the top layer and the bottom, or other suitable spacing (equidistant is shown). Vertical spacing distances 12, 14 may account for the weight distribution of the pipe, which shifts toward the top of the inner box with larger bowl sizes. For trapezoidal inner boxes, vertical spacing between the top and middle layers allows the tapering design to be contacted and secured at two widths, which improves stability.

The tray insert creates three points of contact with each inner box. When placed in their respective holes, with further reference to FIG. 13, the inner boxes 110 will rest at a first point of contact 16 on the bottom layer 236, will have a second point of contact 18 with the middle layer 234, and a third point of contact 20 with the top layer 232. Such redundant contact points offer enough friction and structure to keep the pipes upright, while allowing the pipes to shift forward or backward, up or down as the system is compressed. The tray 230 holds the pipes in place so that they do not contact each other or the sides of the outer box even in drop conditions, while allowing flexibility in the form of shifting and flexing contact points.

As the tray compresses in the front to back dimension, the inner boxes are able to shift forward or backward with the shifting tray insert, but not enough to leave their position in the tray. The tray insert resists side-to-side compression, however side-to-side flexibility is facilitated by the tray insert sitting unglued in the outer box. Therefore, while unable to compress side-to-side, the tray insert can shift minimally to the left or right against the structure of the outer box. The ability to disperse force vertically or horizontally is thus maintained by the tray design, but the front-to-back compression offers the most substantial protection.

Figure 15:
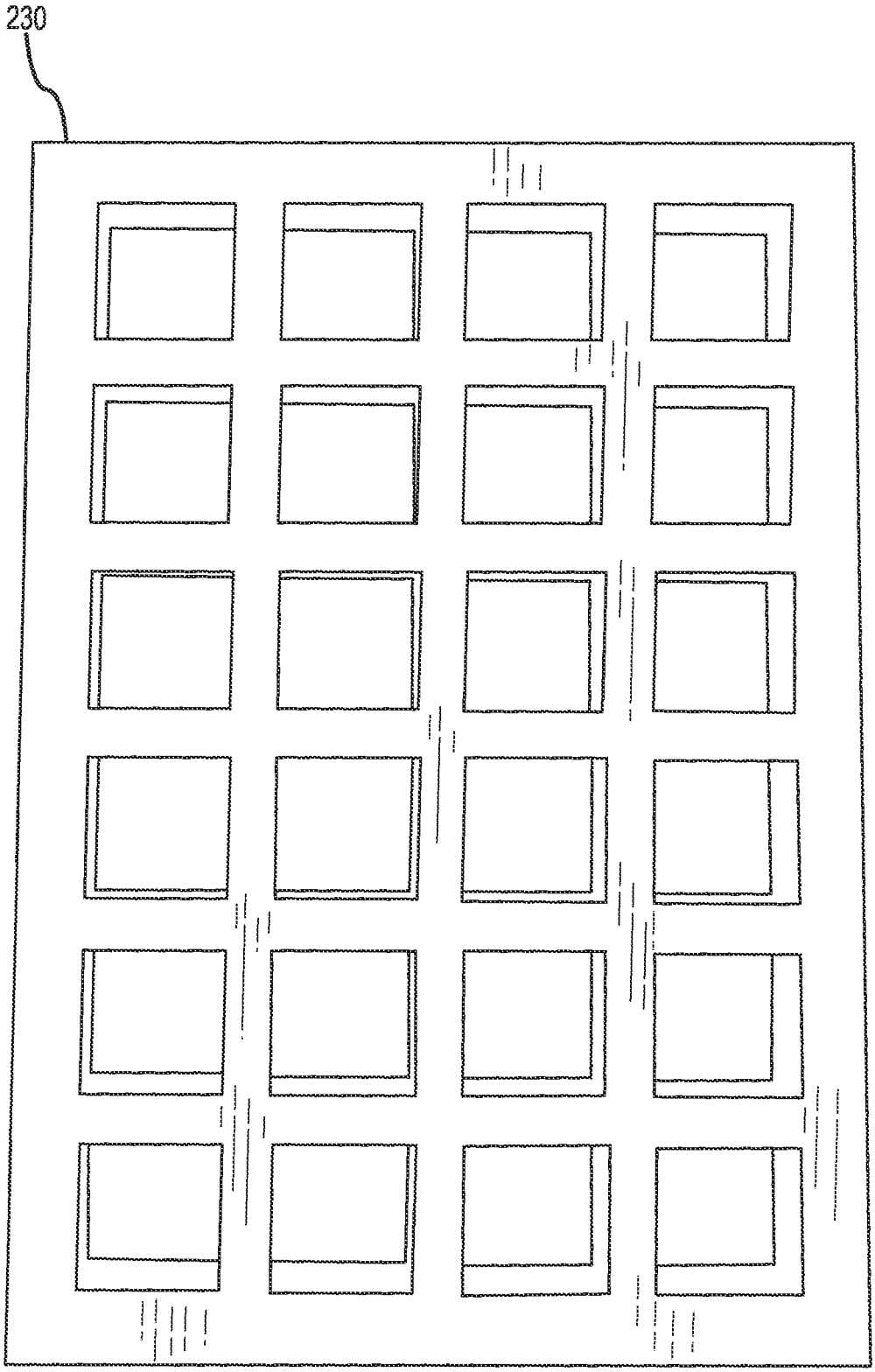
FIG. 15 depicts an overhead view of a tray insert comprising at least a portion of the disclosed packaging system.

For trapezoidal inner boxes, lateral spacing of the tray insert holes is configured to maintain inner boxes at a distance where the wider bowl sections of the pipes can only minimally contact each other in the event the outer box is dropped or hit. The design increases the probability that only one, or one row, of items will be damaged in a dropping or other impact event, because an individual item is almost entirely prevented from front-to-back contact with any other item in the tray. Because the inner box sizes differ with different sized pipes, the tray insert may be configured with more or fewer sets of holes to maintain adequate spacing among pipes and between the pipes and outer box sides. With further reference to FIG. 14 a tray insert 230 is configured with 12 sets of holes, arranged in a 3×4 array, for accommodating 12 pipes. With reference to FIG. 15, a tray insert 230 is configured with 24 sets of holes, arranged in a 4×6 array for accommodating 24 pipes. Other sized sets of holes are possible and contemplated, e.g., 6, 8, 10, 18, 30, etc.

Figure 16:
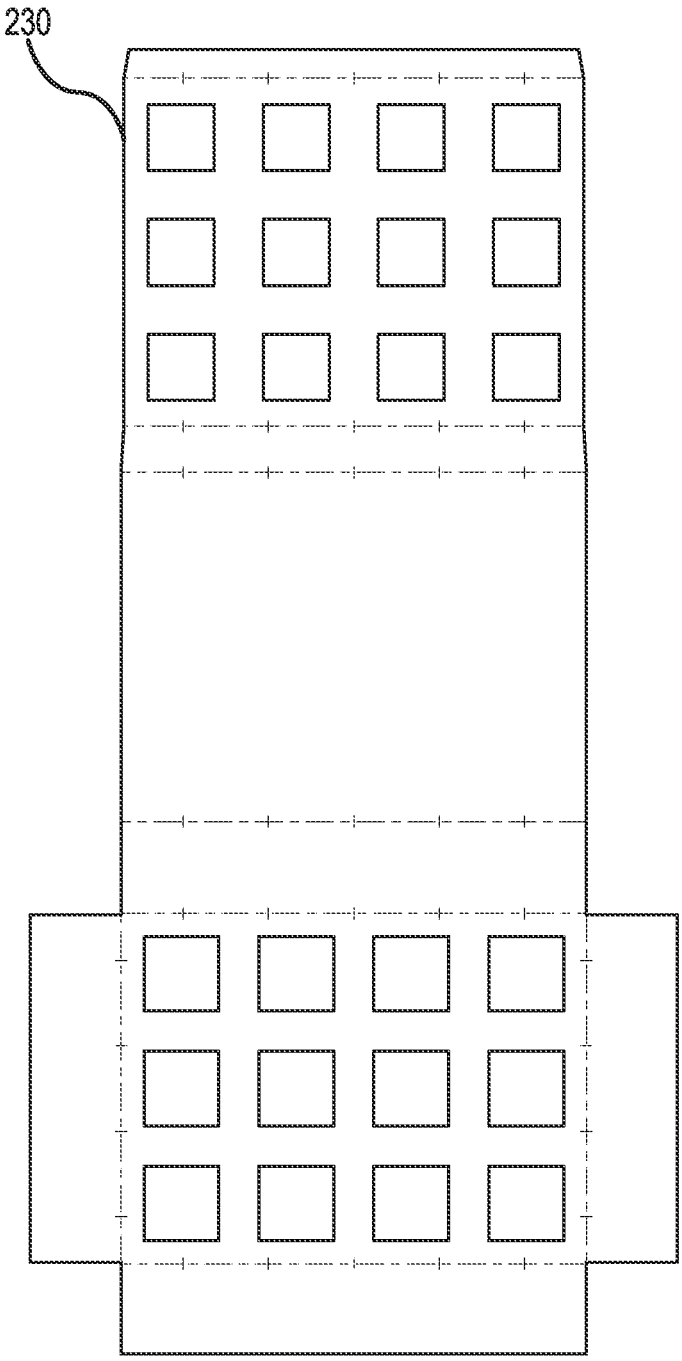
FIG. 16 depicts a pattern for a tray insert prior to folding comprising at least a portion of the disclosed packaging system.
Figure 17:
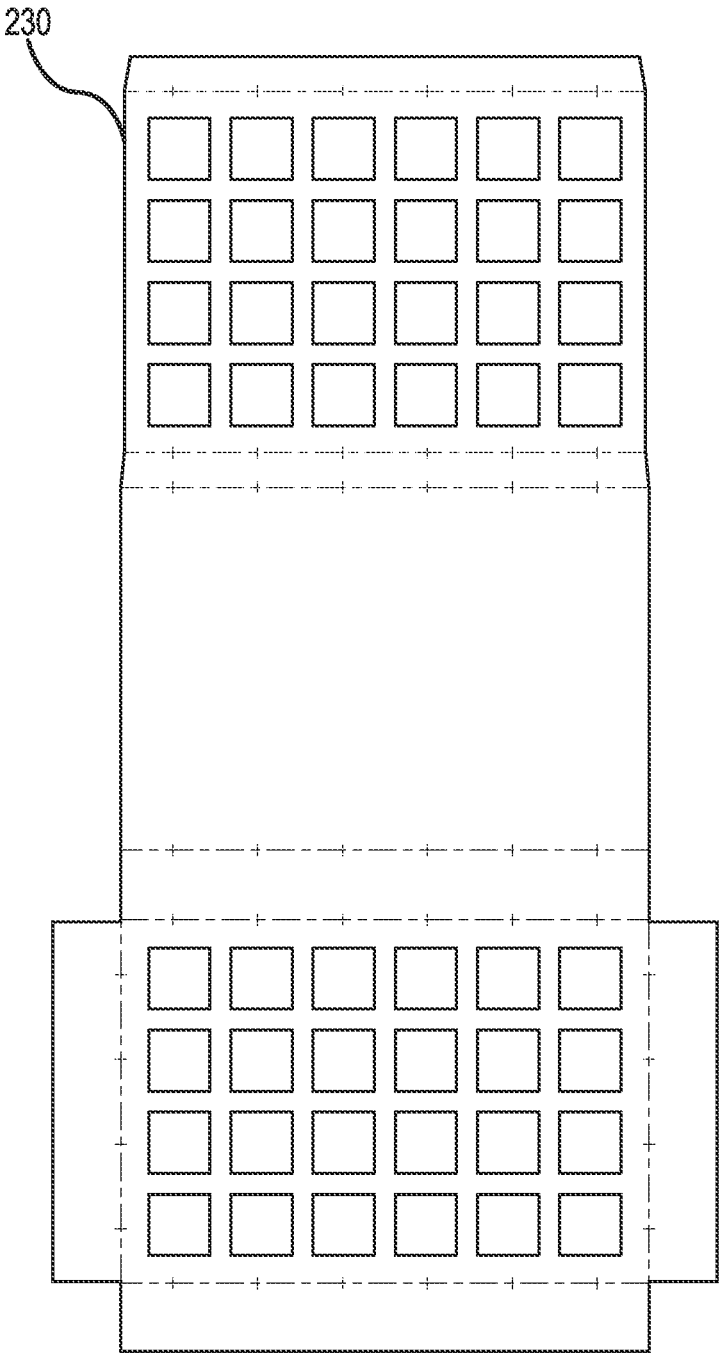
FIG. 17 depicts a pattern for a tray insert prior to folding comprising at least a portion of the disclosed packaging system.
Figure 18:
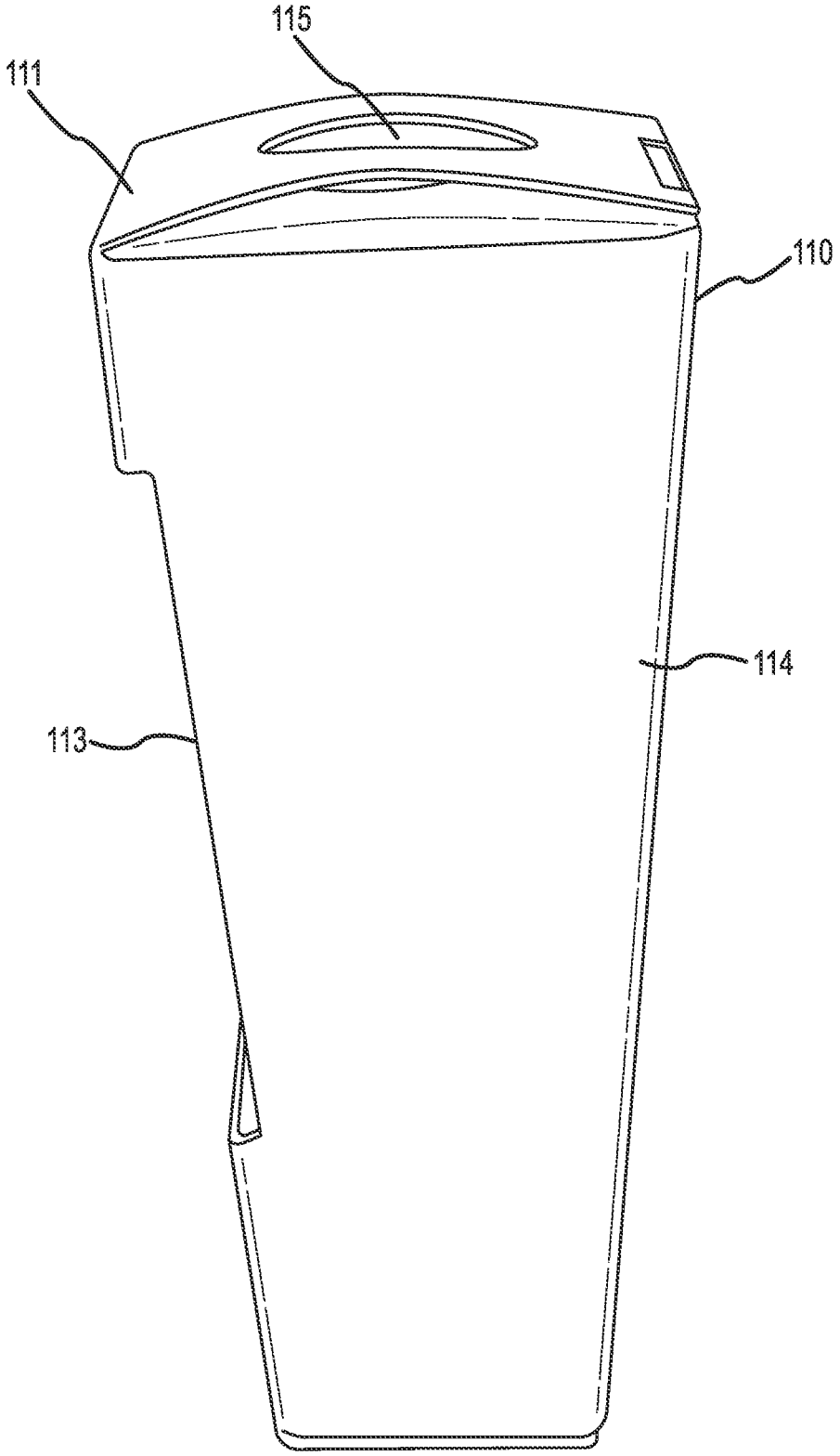
FIG. 18 depicts a left side view of a trapezoidal inner box comprising at least a portion of the disclosed packaging system.
Figure 19:
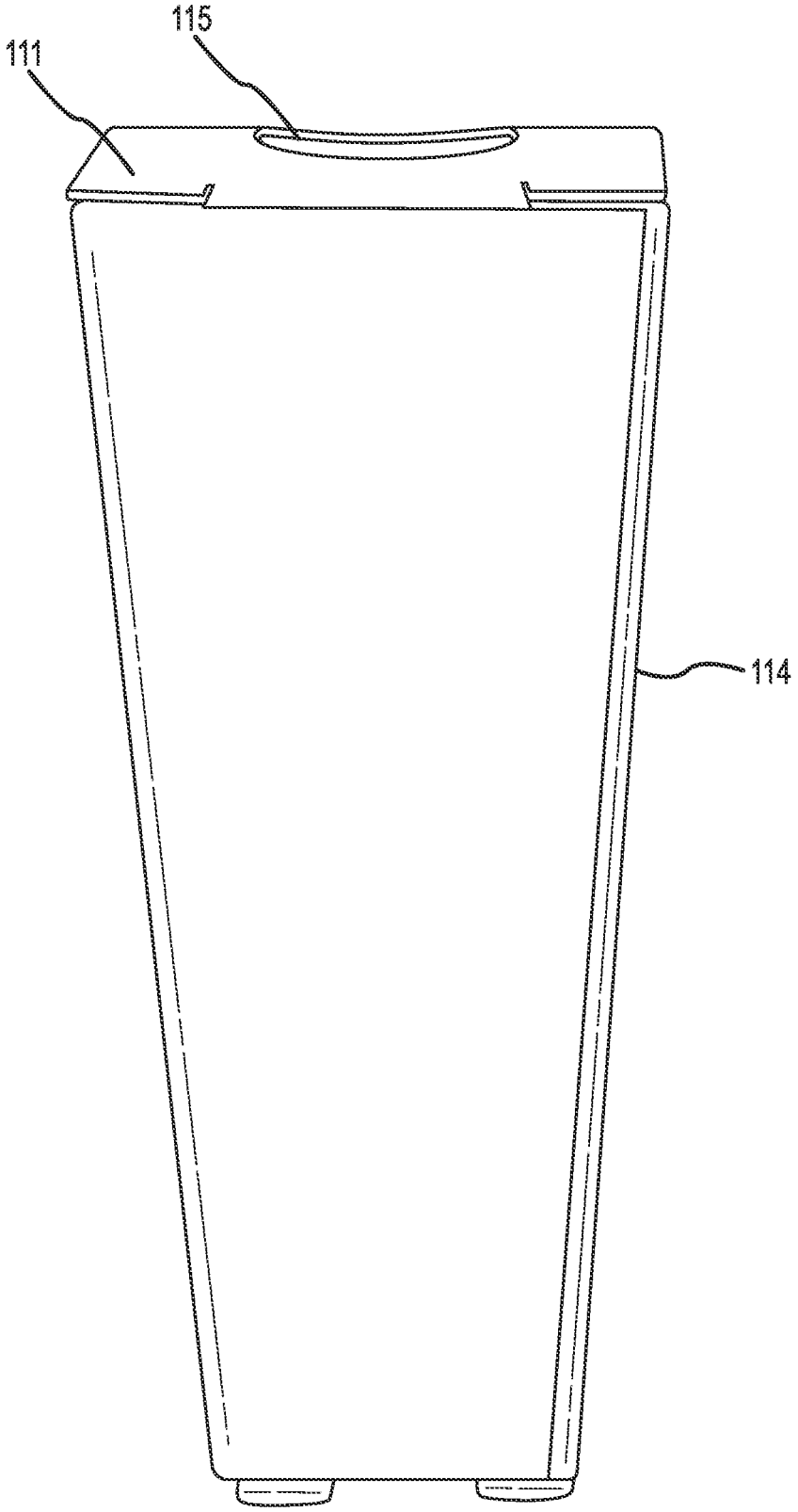
FIG. 19 depicts a rear view of a trapezoidal inner box comprising at least a portion of the disclosed packaging system.
Figure 20:
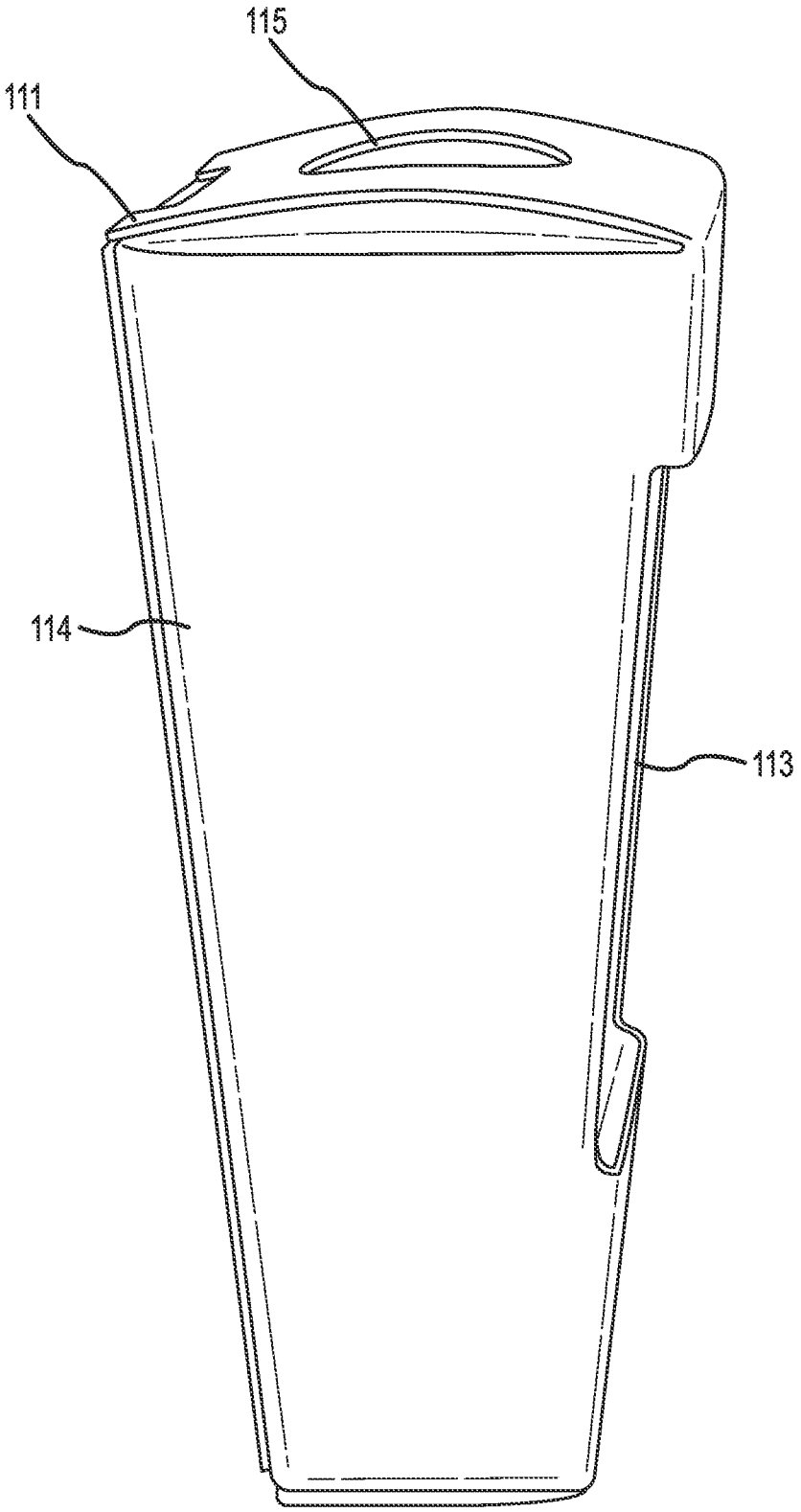
FIG. 20 depicts a right side view of a trapezoidal inner box comprising at least a portion of the disclosed packaging system.
Figure 21:
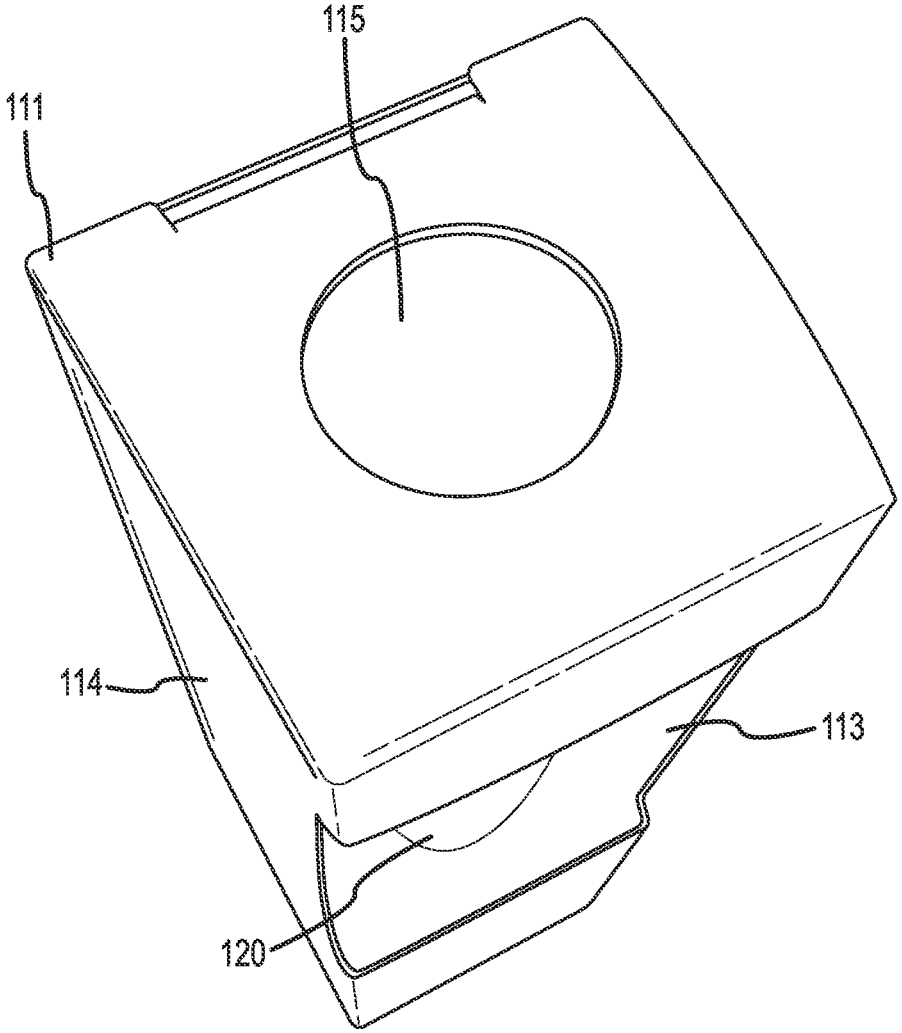
FIG. 21 depicts a top view of a trapezoidal inner box comprising at least a portion of the disclosed packaging system.
Figure 22:
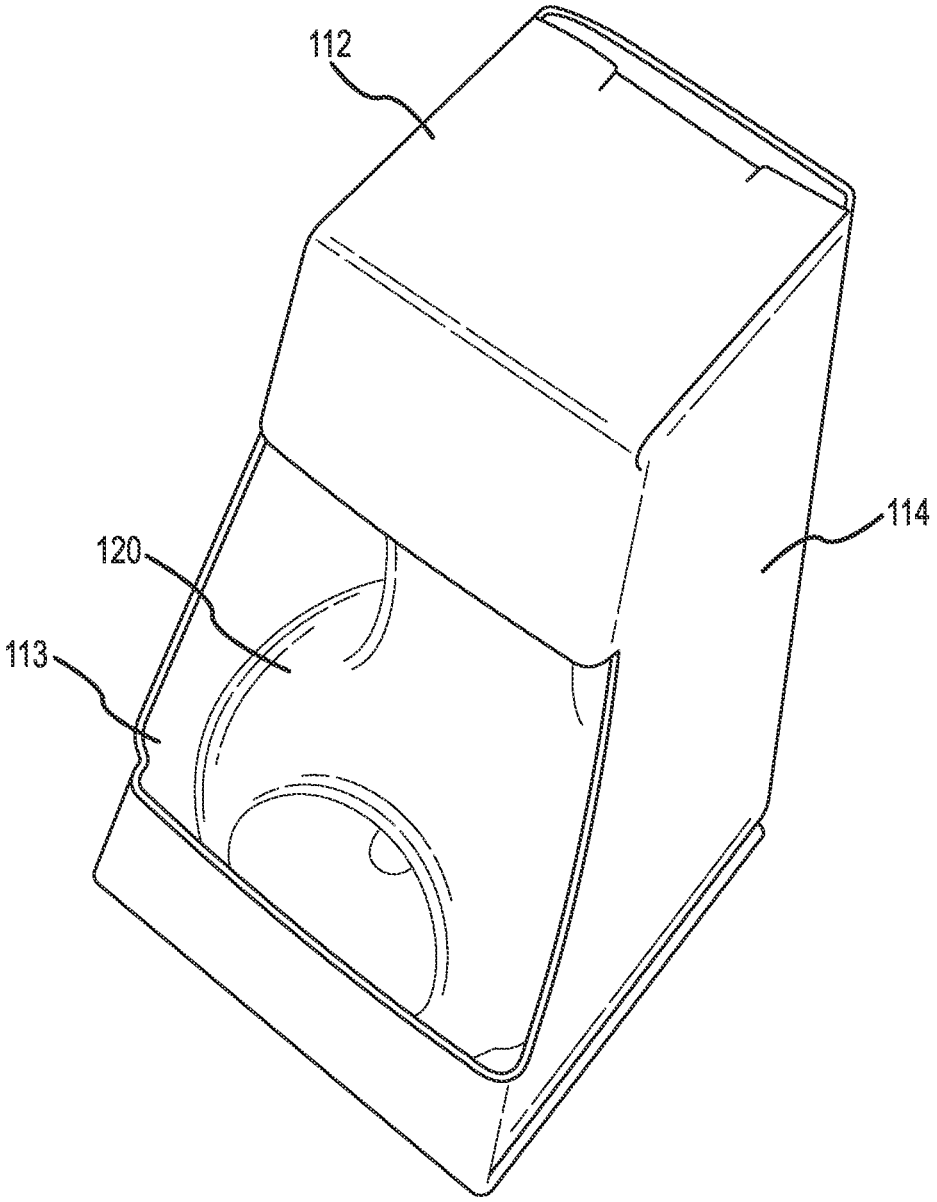
FIG. 22 depicts a bottom view of a trapezoidal inner box comprising at least a portion of the disclosed packaging system.
Figure 23:
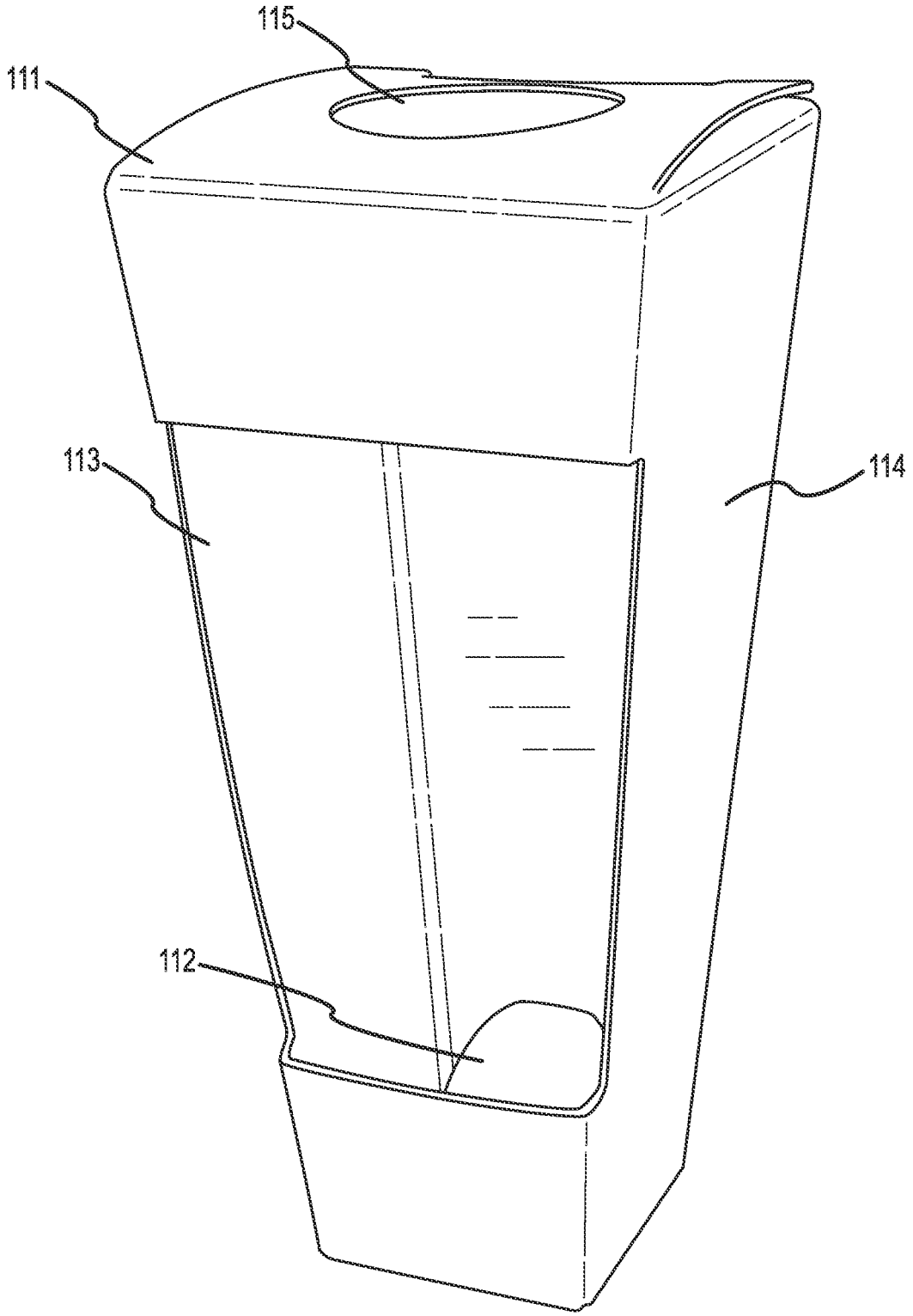
FIG. 23 depicts a front side view of an empty trapezoidal inner box comprising at least a portion of the disclosed packaging system.
Figure 24:
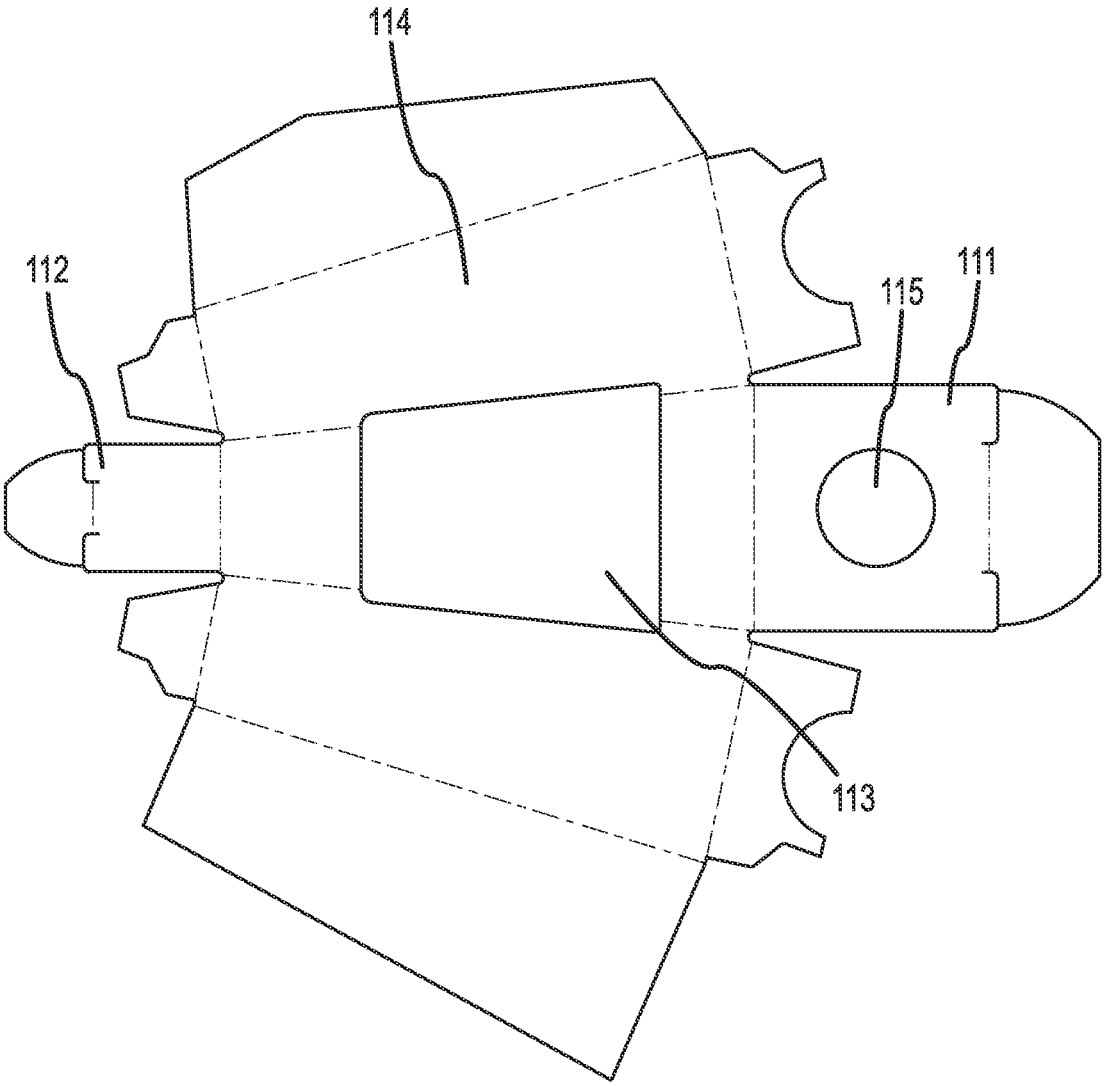
FIG. 24 depicts a pattern for a trapezoidal inner box prior to folding comprising at least a portion of the disclosed packaging system.

FIGS. 16 and 17, depict tray insert 230 forms as they appear prior to being folded into their 3D configuration.

Within the disclosed system, an inner box is included to hold each pipe or other item for distribution and sale. The inner boxes accommodate different pipe shapes and individual variation among pipes to protect the pipes stored inside, while also including display features to make the pipes visible and appealing to customers. Embodiments of the disclosed system include two basic inner box shapes: trapezoidal and rectangular. With further reference to FIG. 1, and with reference to FIGS. 18 to 24, trapezoidal boxes are designed to accommodate pipe 120 designs with a bowl 122 at one end, and therefore have trapezoidal side panels 114 where the top is wider than the bottom. Correspondingly, the top panel 111 is a larger square than the bottom panel 112. Embodiments of bowl-type pipes include 2½ inch, 3 inch, and 4 inch pipes, among others. The trapezoidal box, with its taper towards the bottom, includes enough lateral space to account for individual size variations, but any specific pipe would still contact the box at the top and bottom panels.

With reference to FIGS. 25 to 32, rectangular boxes 110 are designed to enclose in-line pipes 120, e.g., the chillum pipe, that have an in-line bowl 123, and have rectangular side panels 114 and square top 111 and bottom 112 panels that are the same size. The rectangular box includes an additional insert 119 that loosely fits across the diagonal from the right rear corner to the left front corner. The insert holds in-line pipes towards a viewing window 117, and provides additional contact points for the pipe within the inner box while allowing the pipe to move within the box.

Glass pipes and other fragile items are made through the art of glass blowing, which process creates millimeter up to centimeter variations in the dimensions and features of pipes within the same type or classification, e.g., 4 inch bowl-type pipes. The inner box is sized to allow for these variations, so that each pipe is able to move a certain amount within the inner box, but such movement does not allow the pipe to exit the inner box. Further, contact between the inner box and the pipe may vary laterally because of individual variations, but the top and bottom of the inner boxes maintain contact with pipe in all conditions. Rather than being a disadvantage, however, the disclosed system uses the inherent variability among glass pipes to provide enhanced protection by at least two mechanisms. First, pipe-to-pipe variability allows each pipe to move laterally within its box, which dissipates drop and impact forces away from the walls of the inner boxes themselves. Since each pipe is slightly different, such movements tend to dissipate rather than resonate among the individual boxes. Secondly, item movement within its inner box reduces contact between the inner boxes, since each adjacent pipe's ability to move within its own box dissipates forces that typically would be absorbed by inner boxes contacting each other. This second factor is more important to trapezoidal inner boxes, since they are larger at the top, and hence located closer to the tops of adjacent inner boxes.

Figure 25:
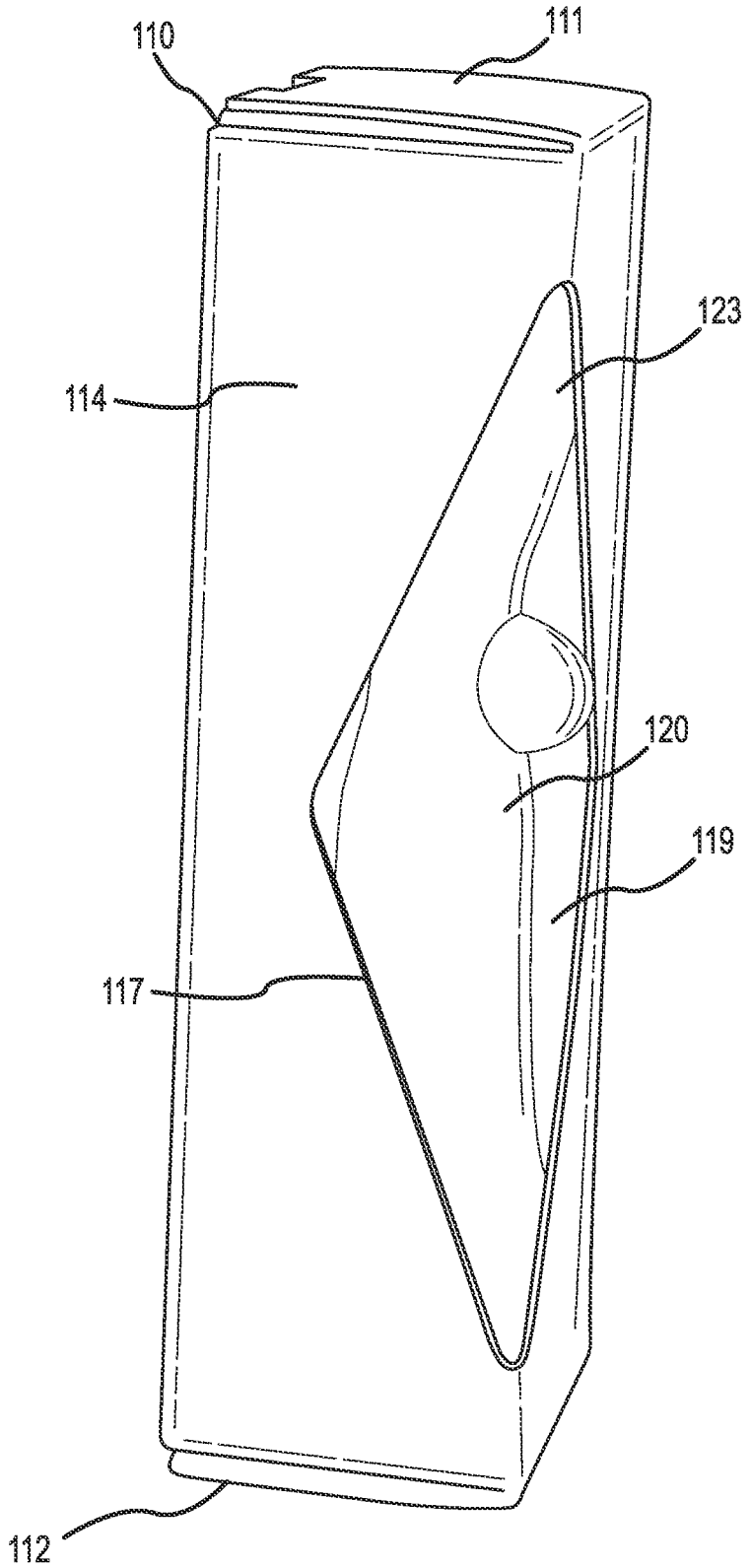
FIG. 25 depicts a front side view of a rectangular inner box comprising at least a portion of the disclosed packaging system.
Figure 26:
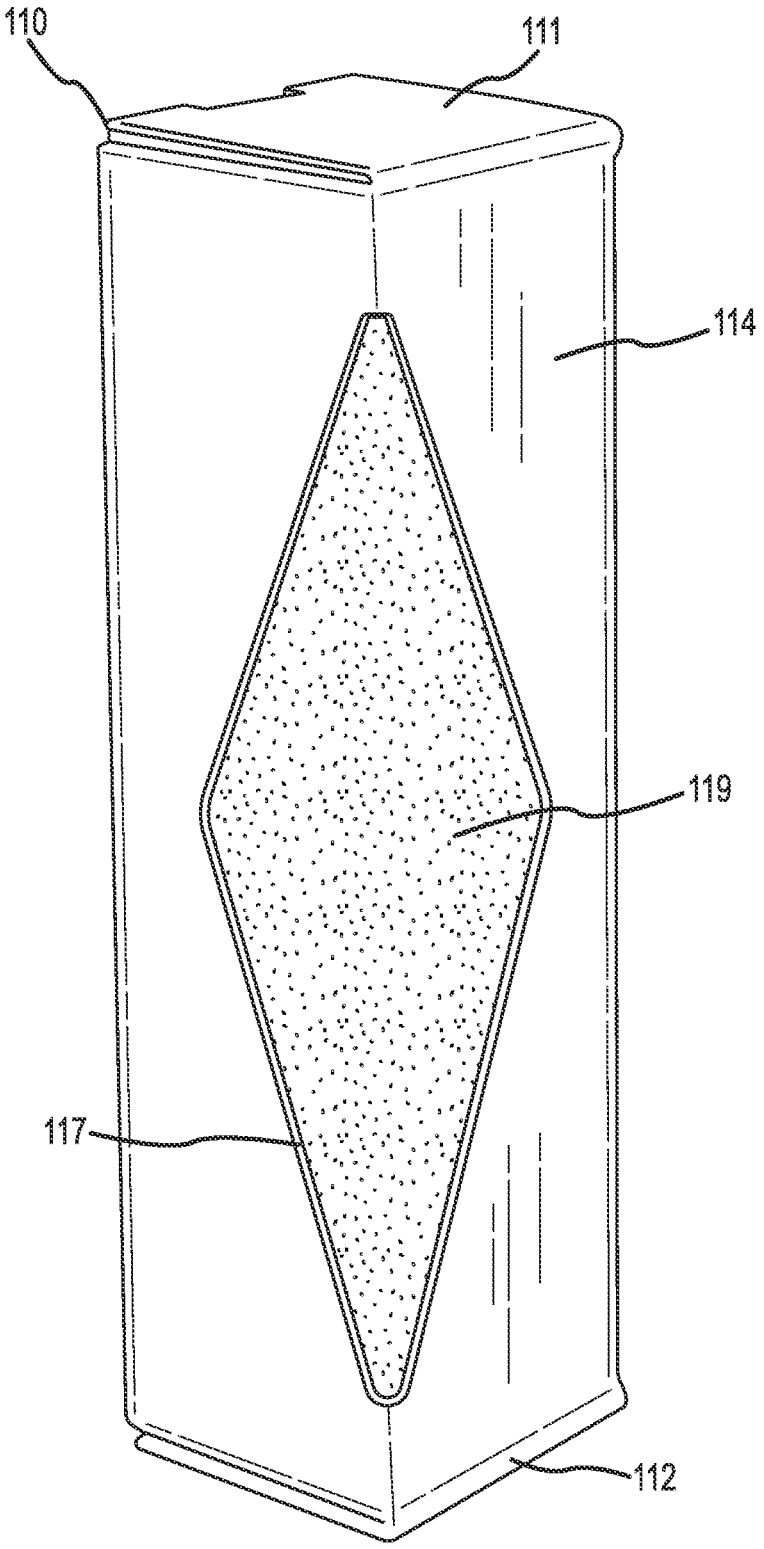
FIG. 26 depicts a front corner view of an empty rectangular inner box comprising at least a portion of the disclosed packaging system.
Figure 27:
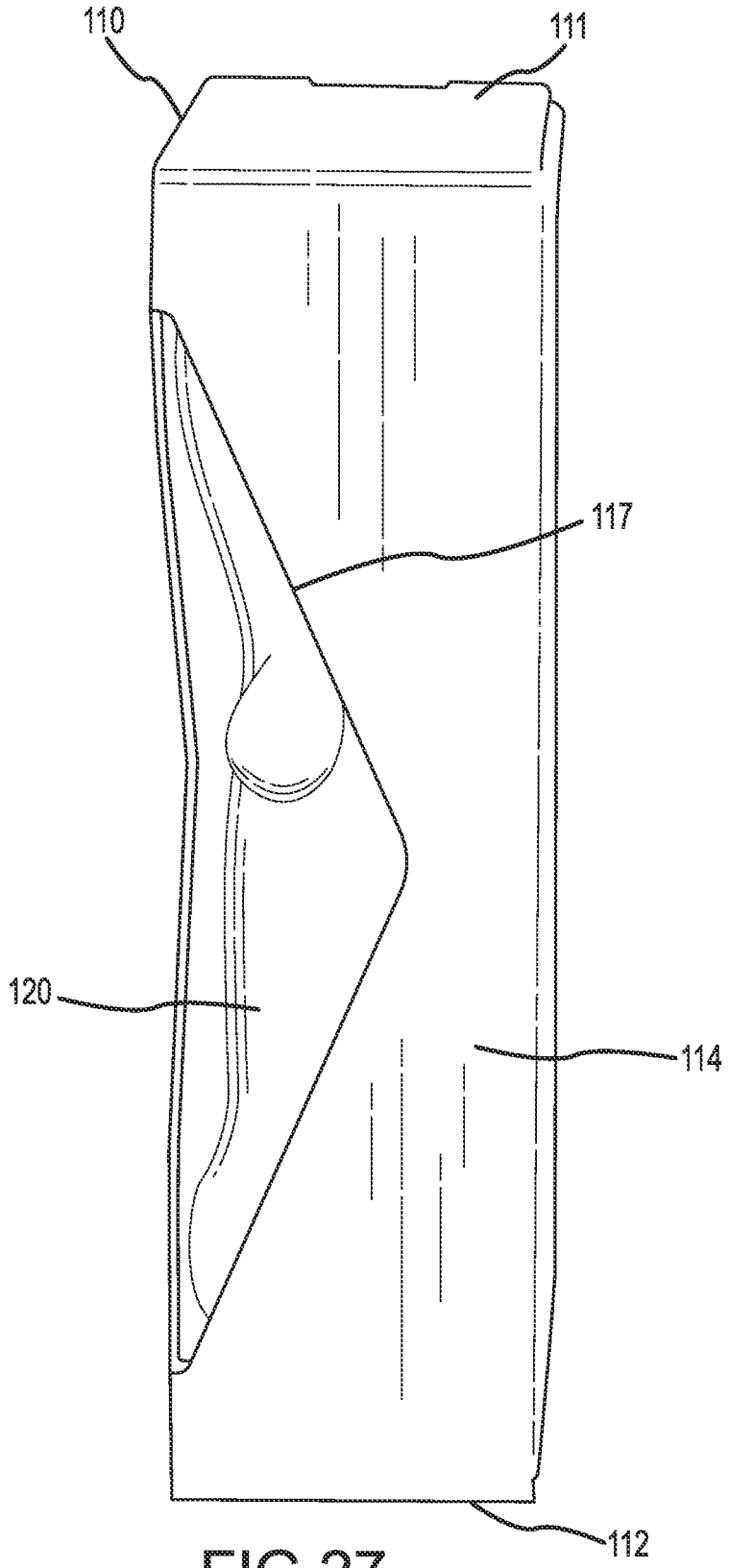
FIG. 27 depicts a left side view of a rectangular inner box comprising at least a portion of the disclosed packaging system.
Figure 28:
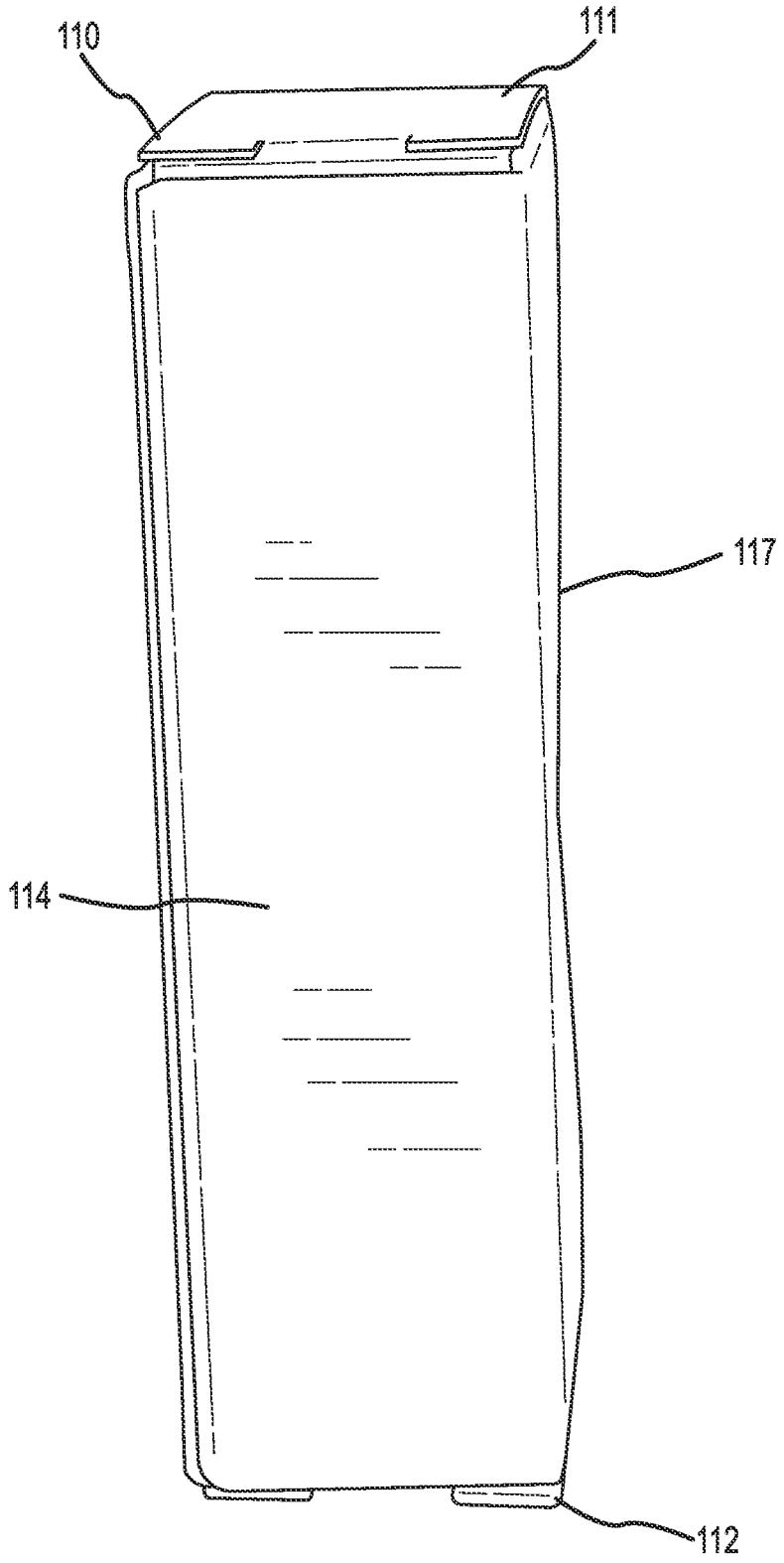
FIG. 28 depicts a rear view of a rectangular inner box comprising at least a portion of the disclosed packaging system.
Figure 29:
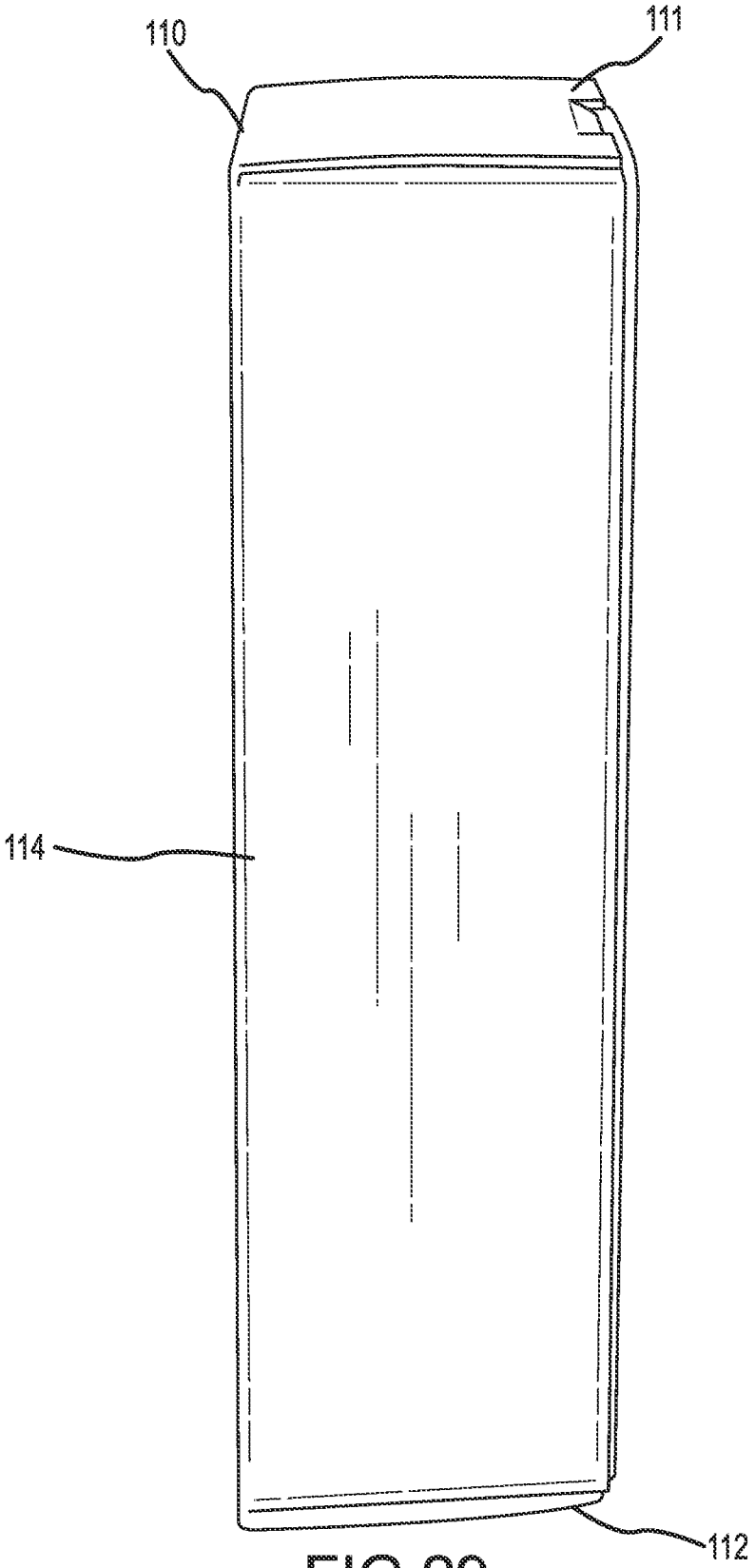
FIG. 29 depicts a right side view of a rectangular inner box comprising at least a portion of the disclosed packaging system.
Figure 30:
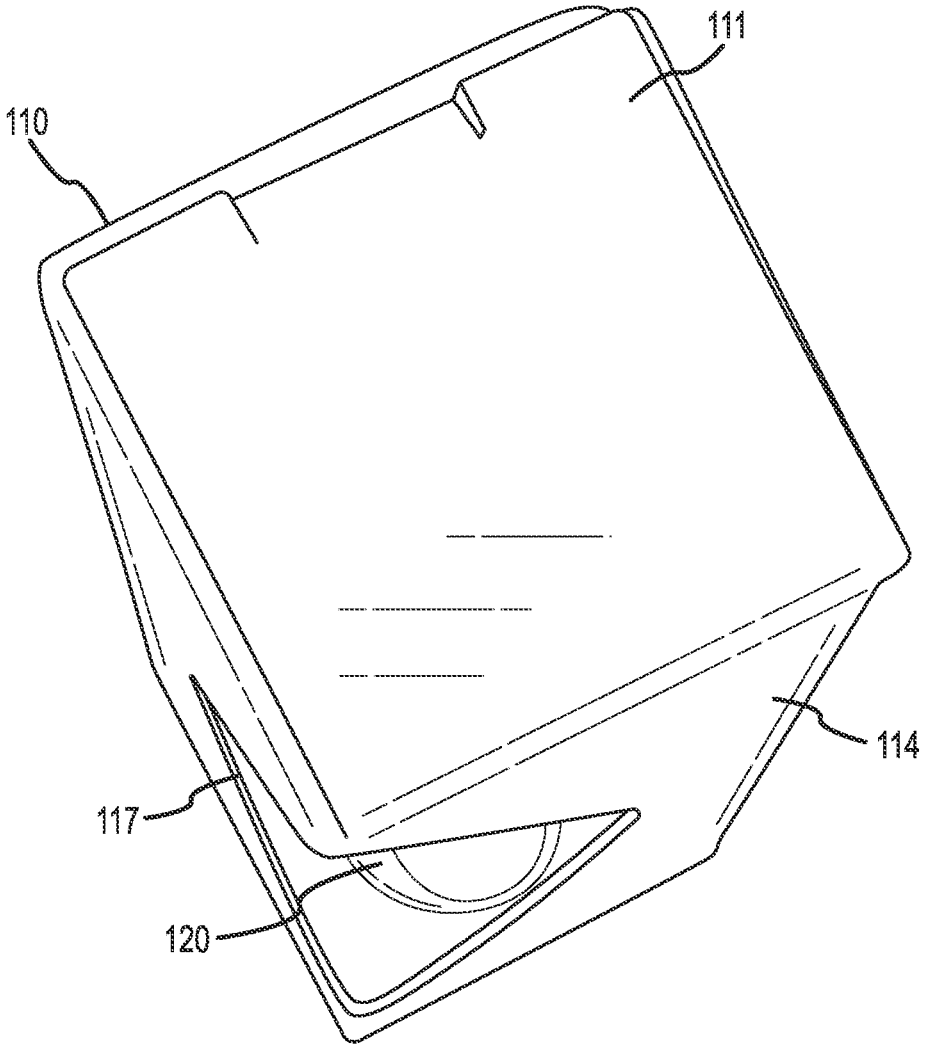
FIG. 30 depicts a top view of a rectangular inner box comprising at least a portion of the disclosed packaging system.
Figure 31:
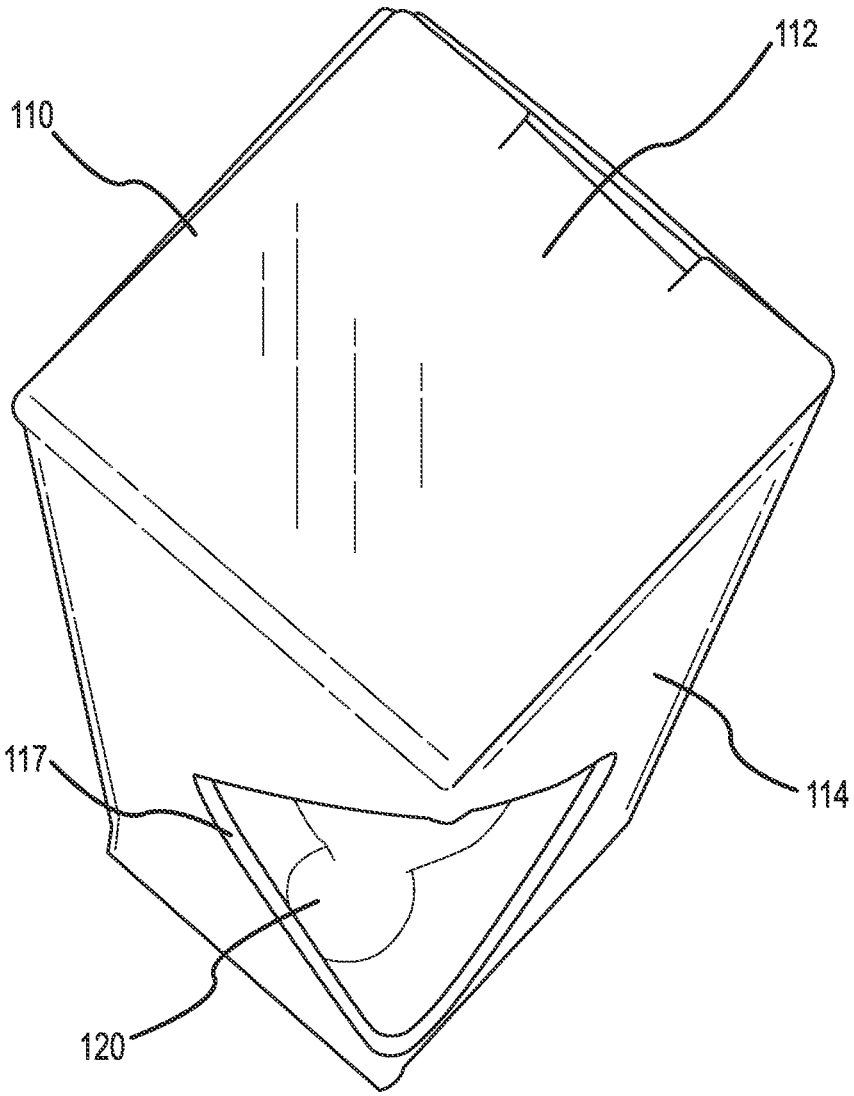
FIG. 31 depicts a bottom view of a rectangular inner box comprising at least a portion of the disclosed packaging system.
Figure 32:
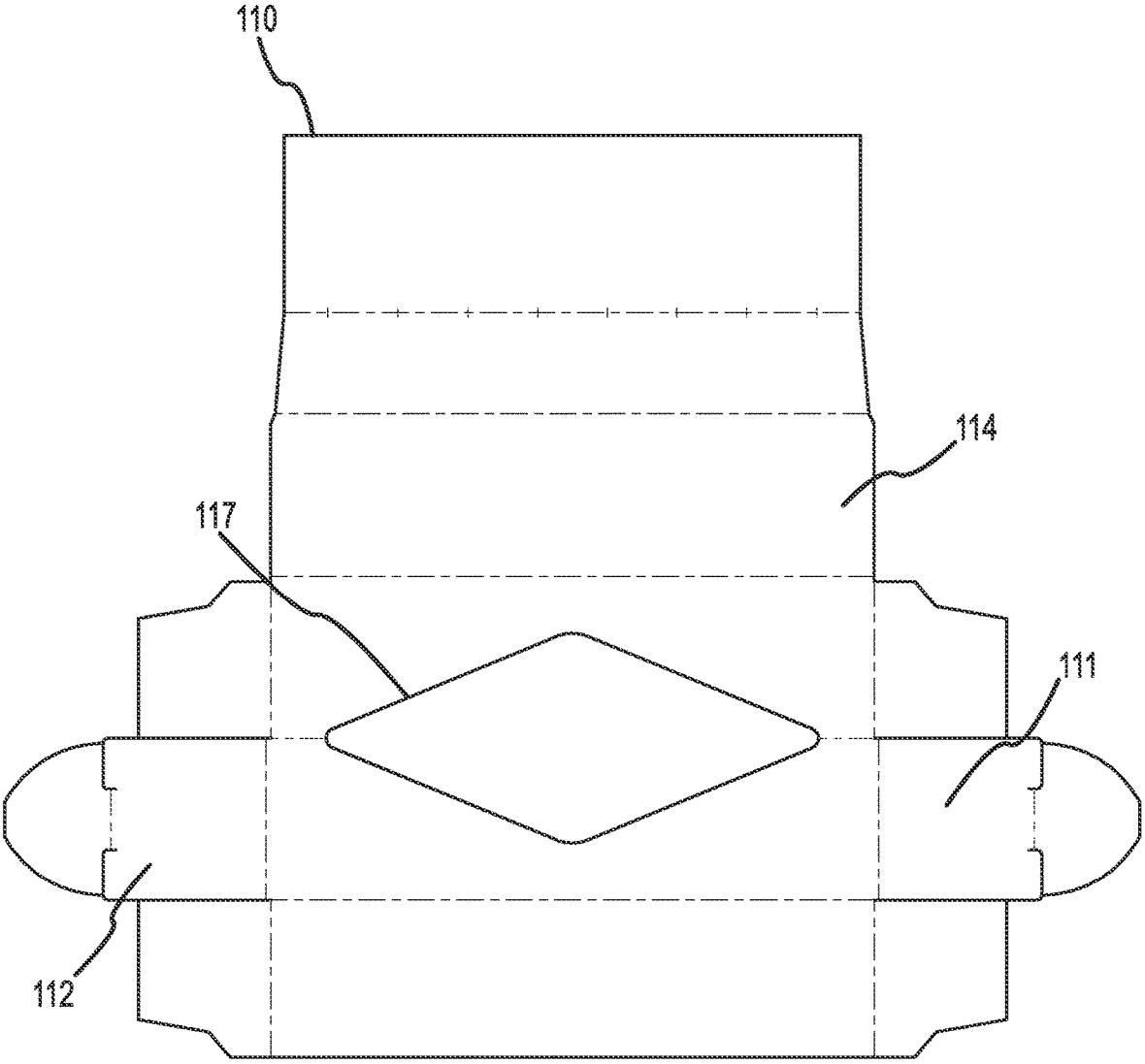
FIG. 32 depicts a pattern for a rectangular inner box prior to folding comprising at least a portion of the disclosed packaging system.

The inner box designs include features to improve the aesthetic appeal of the enclosed pipes while maintaining the boxes' protective function. Glass pipes are nearly all created by hand-blowing glass into specific shapes, and the creative process almost always includes the use of color rods to create unique designs, patterns, or other effects in the glass. The aesthetic features created in the process of blowing glass, along with the size and density of a piece, are the two primary determinates for the market value of the pipe. Inner boxes are designed to display the aesthetic qualities of the glass while protecting it from damage. With further reference to FIGS. 1, and 18 to 24, embodiments using trapezoidal boxes have a cut-out or window 115, which may be circular in shape, in the top panel 111 that allows light into the box. The top window 115 allows a purchaser to view the pipe without compromising the efficiencies and protections offered by the box. Both trapezoidal and rectangular boxes have a window 113, 117 in one or more side panels wherein the panel(s) is partially removed to allow visibility of the pipe inside. The side panel(s) retain material at the top, bottom, and/or sides to ensure the pipe remains within the box even when jostled in transit. Trapezoidal boxes may feature a rectangular window 113 wherein a portion of the side panel 114 oriented to the front side of the box is removed. Additional material may be removed from the two adjacent side panels to enlarge the window laterally, see FIGS. 18 and 20. With reference to FIG. 25, rectangular boxes include a diamond-shaped window 117 centered on a front corner of the box. Material is removed from, for example, the front panel and the adjacent right side panel. In order to better retain smaller pipes in the inner box, some embodiments of either box shape may include an additional belt or strap across the window.

To emphasize the importance of displaying the aesthetic qualities of each pipe, consider the example of consumer light bulb packaging. Light bulbs are usually packed in a rectangular box and an internal corrugated sleeve, both stored within an outer box. Protection of the bulb is primary, since the ability for a consumer to view the glass itself is unimportant to the value of the product. Absent the need to make the glass visible to customers, it would have been straightforward to adapt the basic design of light bulb packaging for use with glass pipes. However, the disclosed system uses similar parts and assembly techniques to configure inner boxes that are shaped and windowed to visually present the aesthetic aspects that are important to the retail display of glass pipes, while retaining the protective characteristics of the box.

The inner boxes are designed to interact with the tray insert and outer box to protect and display each item. Together the three elements interact to provide protection, stability, and flexibility for the pipes inside during compression, twisting, flexing, crushing, and other shocks. In general, the disclosed packaging system protects each item by preventing any glass-on-glass contact within the box, and any direct glass contact with other surfaces during a drop or impact event. Each pipe is able to move inside its inner box, within limitations. The inner boxes are removably placed in the tray insert, which provides three points of contact that can shift and flex to keep the inner boxes in place. The contact point between the bottom of the inner box and the tray insert is configured so that the inner box does not easily or regularly catch on the tray insert when removed. The outer box supports the tray insert, and limits the extent of vertical movement by the inner boxes. Finally, when the tray insert is filled with inner boxes, the boxes add rigidity to the system to further resist compression or flexing of the tray and outer box.

As one of reasonable skill in the relevant art will appreciate, in addition to glass pipes, there are other fragile articles that a retail location may want to hold in inventory and/or display for sale. Indeed, the transportation and display of other fragile supplies and materials, e.g., glass pipets, beakers, other laboratory glassware, art supplies, and jewelry, are within the scope of the disclosed invention. Generally, the system is applicable to any fragile item in a set of identical or similar items that is currently labor intensive for a supply chain at any level.

Other embodiments may use various shapes for the inner boxes, e.g., a cylinder, a pyramid, a hexagonal prism, or other shapes. Other embodiments may use materials other than paper or cardboard stock, such as various plastics, polymers, corn starch, or other suitable materials that combine light weight, strength, flexibility, and low cost.

In addition to providing protection and display capability, the disclosed invention also removes a significant portion of the labor associated with the distribution, retail presentation, and sale of fragile items. The disclosed system has a standardized size and shape, and is stackable, so that the system can be efficiently palletized or shelved. The outer box and each inner box may be printed with various types of tracking codes, e.g., universal product codes (UPC), international article numbers (EAN), radio frequency identification (RFID) tags, serial numbers, etc., to allow distributors or retailers to track the product with electronic tracking systems. The outer boxes can be scanned and tracked easily throughout the various points in distribution down to purchase by an individual retail business. Further, because individual items are packaged within their own inner boxes, retailers can scan the inner box into their point-of-sale system, assign each box to inventory, apply a price, and track each sale.

The system also makes retail display efficient and standardized. To display the products, retailers will tear open the top of the outer box along perforated lines FIG. 3, item 341, fold the top back along the crease 345, and insert a tab FIG. 5, item 550 into a corresponding slot 552 at the back of the box. In display mode, see FIG. 4, the system will have a standardized footprint, which facilitates use across retail chains, and improves compatibility with other retail display systems. Consumers will then easily see and purchase an inner box containing a glass pipe. The system therefore provides a platform for fragile articles to be sold with the same efficiency and standardization expected or required for most other common products.

The packaging system also protects against contamination and potential injury, especially in a retail setting when there is a need to touch or interact with the item during a sale or in the process of refilling a display case or dispenser. The disclosed system prevents breakage and shields individual pipes from glass debris, and it reduces contamination by limiting direct contact with the pipes, either by hand, mouth, breath, bodily fluids, etc., if a retailer handles the article prior to sale to an end user.

Validation Testing

Experimental Goal: To measure the system's ability to prevent pipe breakage if a completely full box in its closed (pre-display) format is dropped. The experiment uses the 6-foot drop height common for the distribution shelving that is used to store 12 or 24 boxes of the disclosed system. Outer boxes were dropped separately to remove any additional protection that might be added if multiple boxes were palletized and dropped together.

Experimental Design: The testing assumed that the system would likely be exposed to drops of less than 10 feet ('), therefore testing included 10 trials during which the system would be dropped from 3' and 6' in four different orientations for striking the ground: 1) bottom (flat), 2) side (flat), 3) 3-fold Corner (Back left or right/front left or right), and 4) 2-fold corners down the length of the box. Separate testing on pipes placed only in an inner box showed that pipes dropped from 3' broke or cracked at least 60% of the time, and when dropped from 6', broke more than 85% of the time. The glass pipes used for validation testing are made of 'soft glass,' one of the most fragile types of glass pipe. After being dropped in each of the 10 trials, the pipes were removed from the tray and inner box and inspected under industrial lighting for cracks or breaks. The boxes were dropped directly on flat and smooth warehouse concrete flooring that had no indentations or protruding features.

Hypothesis: In the 10 trials per type of pipe, e.g., 2½ inch ("), 3", 4", and chillum, the system was expected to preserve more than 90% of the pipes. Preservation of a pipe was defined as the pipe having no visible cracks on the surface or in the interior and having no pieces broken from the pipe.

Results: The trials resulted in 100% pipe preservation in all of the four dropping configurations from 3' and 6'. There was no cracking or breaking found in the testing of 720 boxed pipes.

Analysis: Analysis of the boxes that underwent testing revealed several aspects of the disclosed system that likely contributed to the 100% pipe preservation rate.

First, the outer box crumples to dissipate impact forces. This feature, akin to crumple zones at the front and rear of most cars, allows the box to give about 1-3 mm for SBS-constructed outer boxes, which dissipates the drop force away from the box's internal contents while preserving the overall structure of the box.

Secondly, in flat drop conditions, the tray insert and the inner boxes flex and compress to dissipate impact forces. The insert tray tends to compress horizontally, so that the top layer moves 1-5 mm in one direction, while the middle and bottom layers move in the opposite direction. The inner boxes rest in the tray holes and are held in place by friction, which allows them to move relative to the tray layers upon impact. Such movement dissipates force away from the pipes themselves.

Third, the inner boxes are sized so that individual shape or size variations among the pipes causes the pipes to react slightly differently to impact forces, causing those forces to dissipate as the pipes exert random forces on the inner boxes. Because each pipe may vary in its strict dimensions from 1-5 mm at any point of contact with its inner box, there is enough variation in the individual pipe's connection to its inner box that the impact forces cause slightly different reactions from each of the slightly different sized pipes. The randomized movements of the pipes in response to impact prevents the impact force from concentrating enough to fracture or break any single pipe.

The system of the present invention offers a universal platform maximizing protection while offering inventory tracking, loss prevention, and maintaining an aesthetic presentation of glass pipes and other items.

As will be understood by those familiar with the art, the invention may be embodied in other specific forms without departing from the spirit or essential characteristics thereof. Likewise, the particular naming and division of the modules, managers, functions, systems, layers, features, attributes, methodologies, and other aspects are not mandatory or significant, and the mechanisms that implement the invention or its features may have different names, divisions, and/or formats. Accordingly, the disclosure of the present invention is intended to be illustrative, but not limiting, of the scope of the invention, which should be discerned from the appended claims.

What is claimed is:

1. A method for distribution, storing and displaying fragile items, the method comprising:

constructing an outer box, the outer box having a top, a bottom, a left side, a right side, a front, and a back, each an outer box wall;

inserting a tray within the outer box wherein the tray includes a top tier, a middle tier, and a bottom tier wherein the top tier includes a first array of rectangular holes, the middle tier includes a second array of rectangular holes, and wherein the first array is aligned with the second array, and wherein the tray is sized to fit adjacent to the bottom, the left side, the right side, the back, and the front of the outer box, and wherein each side of the tray is in contiguous contact with one of the outer box walls and the bottom tier is in contiguous contact with the bottom of the outer box; and placing a plurality of inner boxes in the tray wherein each of the plurality of inner boxes includes a plurality of sides that mechanically and continuously interacts with one of the rectangular holes in the first array, mechanically and continuously interacts with one of the rectangular holes in the second array, and a bottom that rests on the bottom tier thereby isolating each inner box from any other of the plurality of inner boxes and from each outer box wall.

2. The method for distribution, storing and displaying fragile items of claim 1, further comprising converting the outer box to a display mode.

3. The method for distribution, storing and displaying fragile items of claim 2, wherein the outer box in the display mode fits within a standard display footprint.

4. The method for distribution, storing and displaying fragile items of claim 1, wherein each of the plurality of inner boxes includes one or more windows to display a fragile item.

5. The method for distribution, storing and displaying fragile items of claim 1, further comprising configuring the tray to hold one of the following numbers of inner boxes: 6, 8, 10, 12, 18, 24, or 30.

6. The method for distribution, storing and displaying fragile items of claim 1, further comprising configuring the tray to provide lateral spacing between each of the plurality of inner boxes and between each of the plurality of inner boxes and the outer box.

7. The method for distribution, storing and displaying fragile items of claim 1, wherein each of the plurality of inner boxes can move independently within the tray insert upon an impact to the outer box.

8. The method for distribution, storing and displaying fragile items of claim 1, further comprising removably seating each of the plurality of inner boxes within a pair of rectangular holes in the tray.

9. The method for distribution, storing and displaying fragile items of claim 1, further comprising configuring each of the plurality of inner boxes to accommodate a glass pipe having an individual size variation.

10. The method for distribution, storing and displaying fragile items of claim 1, further comprising configuring each of the plurality of inner boxes to hold a bowl glass pipe.

11. The method for distribution, storing and displaying fragile items of claim 1, further comprising configuring each of the plurality of inner boxes to hold an in-line glass pipe.

* * * * *